US008186456B2

(12) United States Patent
Tibbitts et al.

(10) Patent No.: US 8,186,456 B2
(45) Date of Patent: May 29, 2012

(54) METHODS OF USING A PARTICLE IMPACT DRILLING SYSTEM FOR REMOVING NEAR-BOREHOLE DAMAGE, MILLING OBJECTS IN A WELLBORE, UNDER REAMING, CORING, PERFORATING, ASSISTING ANNULAR FLOW, AND ASSOCIATED METHODS

(75) Inventors: Gordon Tibbitts, Salt Lake City, UT (US); Greg Galloway, Conroe, TX (US); Adrian Vuyk, Jr., Houston, TX (US); James Terry, Houston, TX (US)

(73) Assignee: PDTI Holdings, LLC, Houston, TX (US)

( * ) Notice: Subject to any disclaimer, the term of this patent is extended or adjusted under 35 U.S.C. 154(b) by 0 days.

(21) Appl. No.: 13/253,413

(22) Filed: Oct. 5, 2011

(65) Prior Publication Data

US 2012/0024601 A1 Feb. 2, 2012

Related U.S. Application Data

(62) Division of application No. 12/363,022, filed on Jan. 30, 2009, now Pat. No. 8,037,950.

(60) Provisional application No. 61/025,589, filed on Feb. 1, 2008.

(51) Int. Cl.
*E21B 43/114* (2006.01)

(52) U.S. Cl. ..... 175/54; 166/55.8

(58) Field of Classification Search ..... 175/54; 166/55, 55.1, 55.7, 55.8
See application file for complete search history.

(56) References Cited

U.S. PATENT DOCUMENTS

| | | | |
|---|---|---|---|
| 2,626,779 | A | 1/1953 | Armentrout |
| 2,724,574 | A | 11/1955 | Ledgerwood, Jr. |
| 2,727,727 | A | 12/1955 | Williams |
| 2,728,557 | A | 12/1955 | McNatt |
| 2,761,651 | A | 9/1956 | Ledgerwood, Jr. |
| 2,771,141 | A | 11/1956 | Lewis |
| 2,779,571 | A | 1/1957 | Ortloff |
| 2,807,442 | A | 9/1957 | Ledgerwood, Jr. |
| 2,809,013 | A | 10/1957 | Ledgerwood, Jr. et al. |
| 2,815,931 | A | 12/1957 | Williams |
| 2,841,365 | A | 7/1958 | Ramsey et al. |
| 2,868,509 | A | 1/1959 | Williams |
| 2,954,122 | A | 9/1960 | Colburn |

(Continued)

FOREIGN PATENT DOCUMENTS

CA 2522568 11/2004

(Continued)

OTHER PUBLICATIONS

Behavior of Suspensions and Emulsion in Drilling Fluids, Nordic Rheology Society, Jun. 14-15, 2007.

(Continued)

*Primary Examiner* — William P Neuder
(74) *Attorney, Agent, or Firm* — Vedder Price P.C.

(57) ABSTRACT

A particle impact drilling system and method are described. In several exemplary embodiments, the system and method may be a part of, and/or used with, an apparatus or system, methods, to excavate a subterranean formation. The system can including, for example, removing near-borehole damage, casing, window milling, fishing, drilling with casing, under reaming, coring, perforating, effective circulatory density management, assisted annular flow, and directional control. Embodiments of associated systems and methods are also included.

6 Claims, 21 Drawing Sheets

U.S. PATENT DOCUMENTS

| | | | |
|---|---|---|---|
| 3,001,652 | A | 9/1961 | Shroeder et al. |
| 3,055,442 | A | 9/1962 | Prince |
| 3,084,752 | A | 4/1963 | Tiraspolsky |
| 3,093,420 | A | 6/1963 | Levene et al. |
| 3,112,800 | A | 12/1963 | Bobo |
| 3,123,159 | A | 3/1964 | Buck |
| 3,132,852 | A | 5/1964 | Dolbear |
| 3,322,214 | A | 5/1967 | Buck |
| 3,374,341 | A | 3/1968 | Klotz |
| 3,380,475 | A | 4/1968 | Armstrong |
| 3,385,386 | A | 5/1968 | Goodwin et al. |
| 3,389,759 | A | 6/1968 | Mori et al. |
| 3,416,614 | A | 12/1968 | Goodwin et al. |
| 3,424,255 | A | 1/1969 | Mori et al. |
| 3,469,642 | A | 9/1969 | Goodwin et al. |
| 3,542,142 | A | 11/1970 | Hasiba et al. |
| 3,548,959 | A | 12/1970 | Hasiba et al. |
| 3,560,053 | A | 2/1971 | Ortloff |
| 3,576,221 | A | 4/1971 | Hasiba |
| 3,645,346 | A | 2/1972 | Miller et al. |
| 3,667,557 | A | 6/1972 | Todd et al. |
| 3,688,852 | A | 9/1972 | Gaylord et al. |
| 3,688,859 | A | 9/1972 | Maurer |
| 3,704,966 | A | 12/1972 | Beck, Jr. |
| 3,831,753 | A | 8/1974 | Gaylord et al. |
| 3,838,742 | A | 10/1974 | Juvkam-Wold |
| 3,852,200 | A | 12/1974 | Meyer |
| 3,865,202 | A | 2/1975 | Takahashi et al. |
| 3,924,698 | A | 12/1975 | Juvkam-Wold |
| 4,042,048 | A | 8/1977 | Schwabe |
| 4,067,617 | A | 1/1978 | Bunnelle |
| 4,141,592 | A | 2/1979 | Lavon |
| 4,266,621 | A | 5/1981 | Brock |
| 4,304,609 | A | 12/1981 | Morris |
| 4,361,193 | A | 11/1982 | Gravley |
| 4,391,339 | A | 7/1983 | Johnson, Jr. et al. |
| 4,444,277 | A | 4/1984 | Lewis |
| 4,476,027 | A | 10/1984 | Fox |
| 4,490,078 | A | 12/1984 | Armstrong |
| 4,492,276 | A | 1/1985 | Kamp |
| 4,497,598 | A | 2/1985 | Blanton |
| 4,498,987 | A | 2/1985 | Inaba |
| 4,534,427 | A | 8/1985 | Wang et al. |
| 4,624,327 | A | 11/1986 | Reichman |
| 4,627,502 | A | 12/1986 | Dismukes |
| 4,681,264 | A | 7/1987 | Johnson |
| 4,699,548 | A | 10/1987 | Bergstrom |
| 4,768,709 | A | 9/1988 | Yie |
| 4,809,791 | A | 3/1989 | Hayatdavoudi |
| 4,825,963 | A | 5/1989 | Ruhle |
| 4,852,668 | A | 8/1989 | Dickinson, III et al. |
| 5,199,512 | A | 4/1993 | Curlett |
| 5,291,957 | A | 3/1994 | Curlett |
| 5,355,967 | A | 10/1994 | Mueller et al. |
| 5,421,420 | A | 6/1995 | Malone et al. |
| 5,542,486 | A | 8/1996 | Curlett |
| 5,718,298 | A | 2/1998 | Rusnak |
| 5,799,734 | A | 9/1998 | Norman et al. |
| 5,862,871 | A | 1/1999 | Curlett |
| 5,881,830 | A | 3/1999 | Cooley |
| 5,897,062 | A | 4/1999 | Enomoto et al. |
| 5,944,123 | A | 8/1999 | Johnson |
| 6,003,623 | A | 12/1999 | Miess |
| 6,142,248 | A | 11/2000 | Thigpen et al. |
| 6,152,356 | A | 11/2000 | Minden |
| 6,216,801 | B1 | 4/2001 | Jonnes |
| 6,345,672 | B1 | 2/2002 | Dietzen |
| 6,347,675 | B1 | 2/2002 | Kolle |
| 6,386,300 | B1 | 5/2002 | Curlett et al. |
| 6,474,418 | B2 | 11/2002 | Miramon |
| 6,506,310 | B2 | 1/2003 | Kulbeth |
| 6,530,437 | B2 | 3/2003 | Maurer et al. |
| 6,533,946 | B2 | 3/2003 | Pullman |
| 6,571,700 | B2 | 6/2003 | Nakamura et al. |
| 6,581,700 | B2 | 6/2003 | Curlett et al. |
| 6,601,650 | B2 | 8/2003 | Sunararajan |
| 6,651,822 | B2 | 11/2003 | Alanis |
| 6,732,797 | B1 | 5/2004 | Watters et al. |
| 6,904,982 | B2 | 6/2005 | Judge et al. |
| 6,920,945 | B1 | 7/2005 | Belew et al. |
| 7,090,017 | B2 | 8/2006 | Justus et al. |
| 7,172,038 | B2 | 2/2007 | Terry et al. |
| 7,258,176 | B2 | 8/2007 | Tibbitts |
| 7,343,987 | B2 * | 3/2008 | Tibbitts ..... 175/67 |
| 7,380,617 | B1 | 6/2008 | James |
| 7,383,896 | B2 | 6/2008 | Tibbitts |
| 7,398,838 | B2 | 7/2008 | Harder et al. |
| 7,398,839 | B2 | 7/2008 | Harder |
| 7,503,407 | B2 | 3/2009 | Tibbitts |
| 7,527,095 | B2 | 5/2009 | Bloess et al. |
| 7,757,786 | B2 | 7/2010 | Harder et al. |
| 7,793,741 | B2 | 9/2010 | Harder et al. |
| 7,798,249 | B2 | 9/2010 | Tibbitts |
| 7,798,429 | B1 | 9/2010 | Porter |
| 7,909,116 | B2 | 3/2011 | Tibbitts |
| 7,980,326 | B2 | 7/2011 | Tibbitts et al. |
| 7,987,928 | B2 | 8/2011 | Vuyk, Jr. et al. |
| 7,997,355 | B2 | 8/2011 | Vuyk, Jr. et al. |
| 2002/0134550 | A1 | 9/2002 | Lesson et al. |
| 2006/0011386 | A1 | 1/2006 | Tibbitts |
| 2006/0016622 | A1 | 1/2006 | Tibbitts |
| 2006/0191718 | A1 | 8/2006 | Harder et al. |
| 2008/0156545 | A1 | 7/2008 | Tibbitts |
| 2008/0196944 | A1 | 8/2008 | Tibbitts |
| 2008/0210472 | A1 | 9/2008 | Tibbitts |
| 2009/0038856 | A1 | 2/2009 | Vuyk, Jr. et al. |
| 2009/0200080 | A1 | 8/2009 | Tibbitts et al. |
| 2009/0205871 | A1 | 8/2009 | Tibbitts |
| 2009/0218098 | A1 | 9/2009 | Tibbitts et al. |
| 2009/0223718 | A1 | 9/2009 | Tibbitts |
| 2010/0155063 | A1 | 6/2010 | Tibbitts et al. |
| 2010/0243330 | A1 | 9/2010 | Harder et al. |
| 2010/0294567 | A1 | 11/2010 | Tibbitts |

FOREIGN PATENT DOCUMENTS

| | | |
|---|---|---|
| CA | 2588170 | 5/2007 |
| EP | 0192016 | 8/1986 |
| GB | 2385346 | 8/2003 |
| GB | 2385346 | 9/2004 |
| IQ | 20055376 | 11/2005 |
| WO | 0225053 | 3/2002 |
| WO | 0234653 | 5/2002 |
| WO | 02092956 | 11/2002 |
| WO | 2004094734 | 11/2004 |
| WO | 2004106693 | 12/2004 |
| WO | 2006001997 | 2/2006 |
| WO | 2008006005 | 1/2008 |
| WO | 2008140760 | 11/2008 |
| WO | 2009009792 | 1/2009 |
| WO | 2009049076 | 4/2009 |
| WO | 2009065107 | 5/2009 |
| WO | 2009099945 | 8/2009 |

OTHER PUBLICATIONS

International Search Report PCT/US2005/025092; Dated Mar. 6, 2006.

Written Opinion PCT/US2005/025092; Dated Mar. 6, 2006.

International Preliminary Report on Patentability dated Nov. 19, 2009 on PCT/US2008/005955, 5 pages.

International Preliminary Report on Patentability dated Apr. 17, 2009 on PCT/US2009/032654, 6 pages.

International Search Report dated Dec. 30, 2009 on PCT/US2009/032654, 1 page.

International Preliminary Report on Patentability dated Jan. 12, 2010 on PCT/US2008/069972, 5 pages.

International Search Report dated Sep. 18, 2008 on PCT/US2007/072794, 1 page.

International Preliminary Report on Patentability dated Oct. 9, 2008 on PCT/US2008/069972, 5 pages.

*Curlett Family Limited Partnership, Ltd.*, Plaintiff v. *Particle Drilling Technologies, Inc*, a Delaware Corporation; and *Particle Drilling Technologies, Inc.*, a Nevada Corporation; Affadvit of Harry (Hal B. Curlett); May 3, 2006; 8 pages.

Geddes et al., "Leveraging a New Energy Source to Enhance Heavy-Oil and Oil-Sands Production," Society of Petroleum Engineers, SPE/PS-CIM/CHOA 97781, 2005; 7 pages.

www.particledrilling.com, May 4, 2006.
Anderson, Arthur, "Global E&P Trends" Jul. 1999; 2 pages.
Cohen et al., "High Pressure Jet Kerf Drilling Shows Significant Potential to Increase ROP," SPE 96557, Oct. 2005, pp. 1-8.
Eckel et al., "Development and Testing of Jet Pump Pellet Impact Drill Bits," Petroleum Transactions, Aime, 1956, 1-10, vol. 207.
Fair, John, "Development of High-Pressure Abrasive-Jet Drilling," Journal of Petroleum Technology, Aug. 1981, pp. 1379-1388.
Killalea, Mike, "High Pressure Drilling System Triples ROPS, Stymies Bit Wear," Drilling Technology, Mar.-Apr. 1989, pp. 10-12.
Kolle et al., "Laboratory and Field Testing of an Ultra-High-Pressure, Jet-Assisted Drilling System," SPE/IADC 22000, 1991, pp. 847-856.
Ledgerwood, L., "Efforts to Develop Improved Oilwell Drilling Methods," Petroleum Transactions, Aime, 1960, 61-74, vol. 219.
Maurer, William, "Advanced Drilling Techniques," Chapter 5, pp. 19-27, Petroleum Publishing Co., Tulsa OK 1980.
Maurer, William, "Impact Crater Formation in Rock," Journal of Applied Physics, Jul. 1960, pp. 1247-1252, vol. 31, No. 7.
Maurer, et al., "Deep Drilling Basic Research vol. 1—Summary Report," Gas Research Institute, GRI 90/0265.1, Jun. 1990.
Security DBS, 1995 (2 pages).
Singh, Madan, "Rock Breakage by Pellet Impact," IIT Research Institute, Dec. 24, 1969 (92 pages).
Summers et al., "A Further Investigation of DIAjet Cutting," Jet Cutting Technology—Proceedings of the 10th International Conference, 1991, pp. 181-192; Elsevier Science Publishers Ltd. USA.
Summers, David, "Waterjetting Technology," Abrasive Waterjet Drilling, pp. 557-598, Curators' Professor of Mining Engineering and Director High Pressure Waterjet Laboratory University of Missouri-Rolla Missouri, E & FN SPON, London UK, First Edition 1995 (ISBN 0 419 19660 9).
Veenhuizen et al., "Ultra-High Pressure Jet Assist of Mechanical Drilling," SPE/IADC 37579, pp. 79-90, 1997.
International Search Report for PCT/US2004/011578; dated Dec. 28, 2004 (4 pages).
International Preliminary Report on Patentability for PCT/US2004/011578; dated Oct. 21, 2005 (5 pages).
Written Opinion for PCT/US2004/011578; dated Dec. 28, 2004 (4 pages).
Examination Report dated May 8, 2007 on GCC Patent No. GCC/P/2004/3505 (4 pages).
Co-pending U.S. Appl. No. 12/172,760, filed Jul. 14, 2008, Titled "Injection System and Method".
Co-pending U.S. Appl. No. 12/120,763, filed May 15, 2008, Titled "Impact Excavation System and Method With Particle Separation".
Co-pending U.S. Appl. No. 12/122,374, filed May 16, 2008, Titled "Impact Excavation System and Method With Injection System".

* cited by examiner

Fig. 2
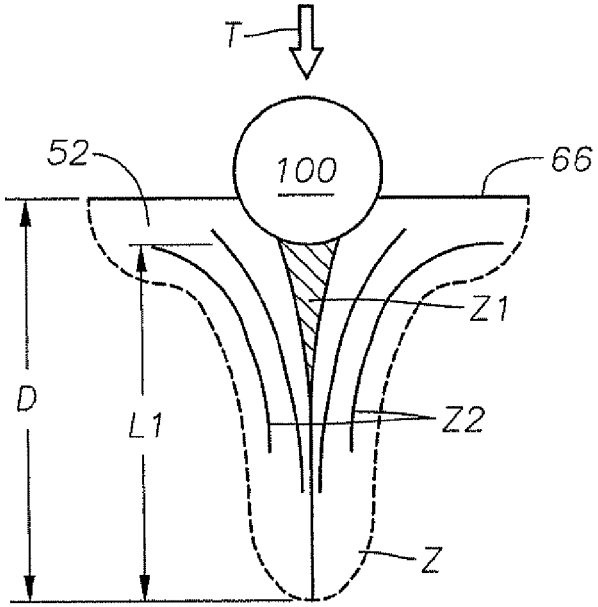
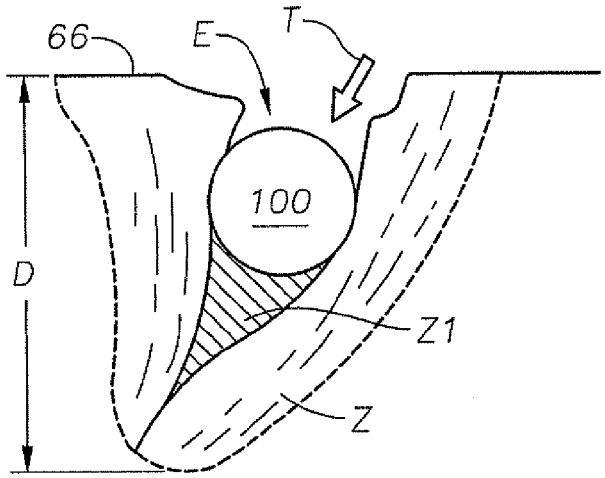
Fig. 3
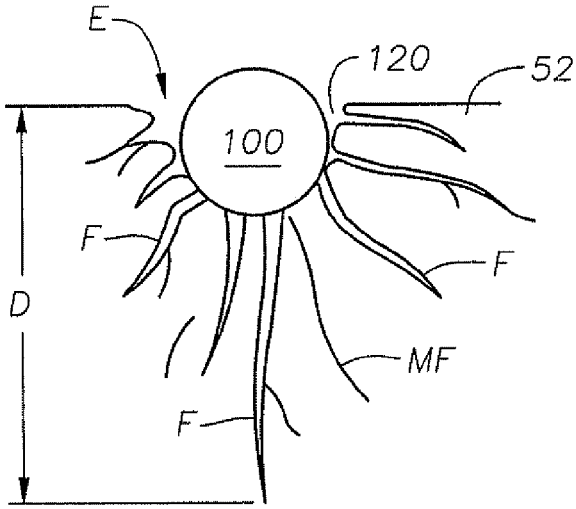
Fig. 4

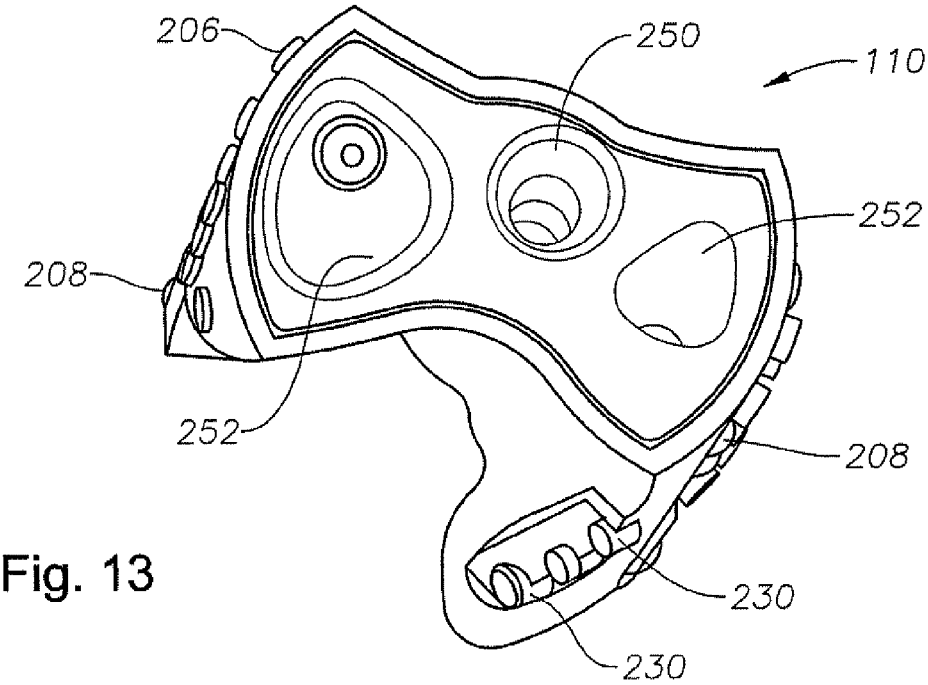
Fig. 13
Fig. 14
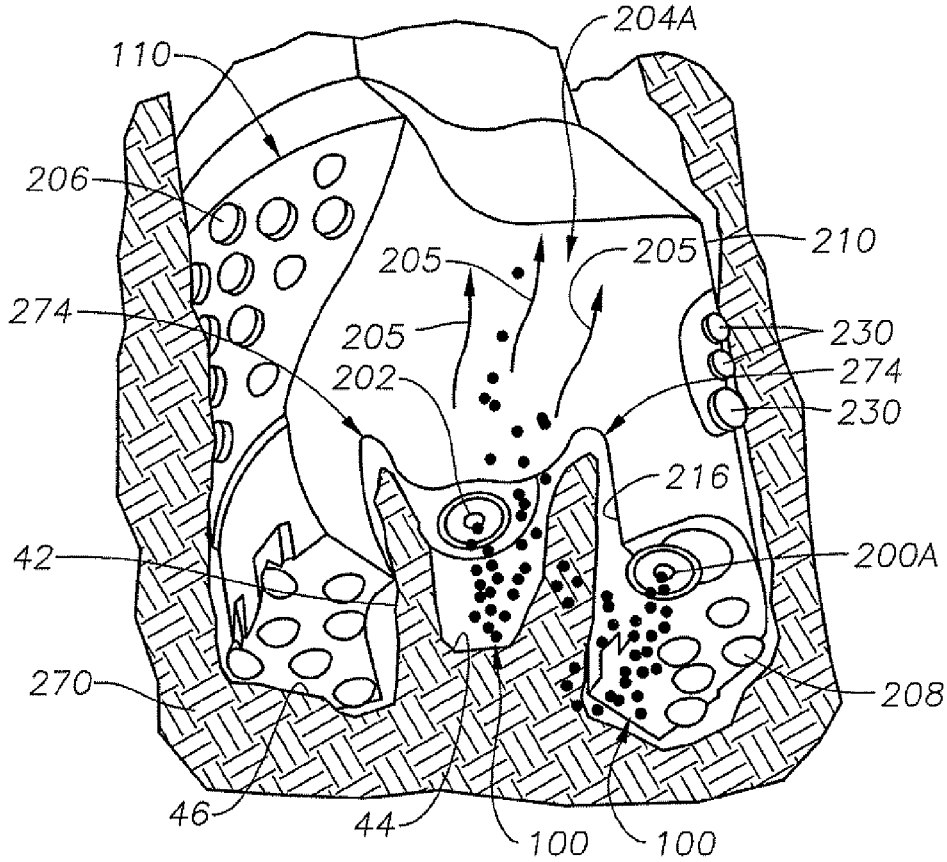

Fig. 20
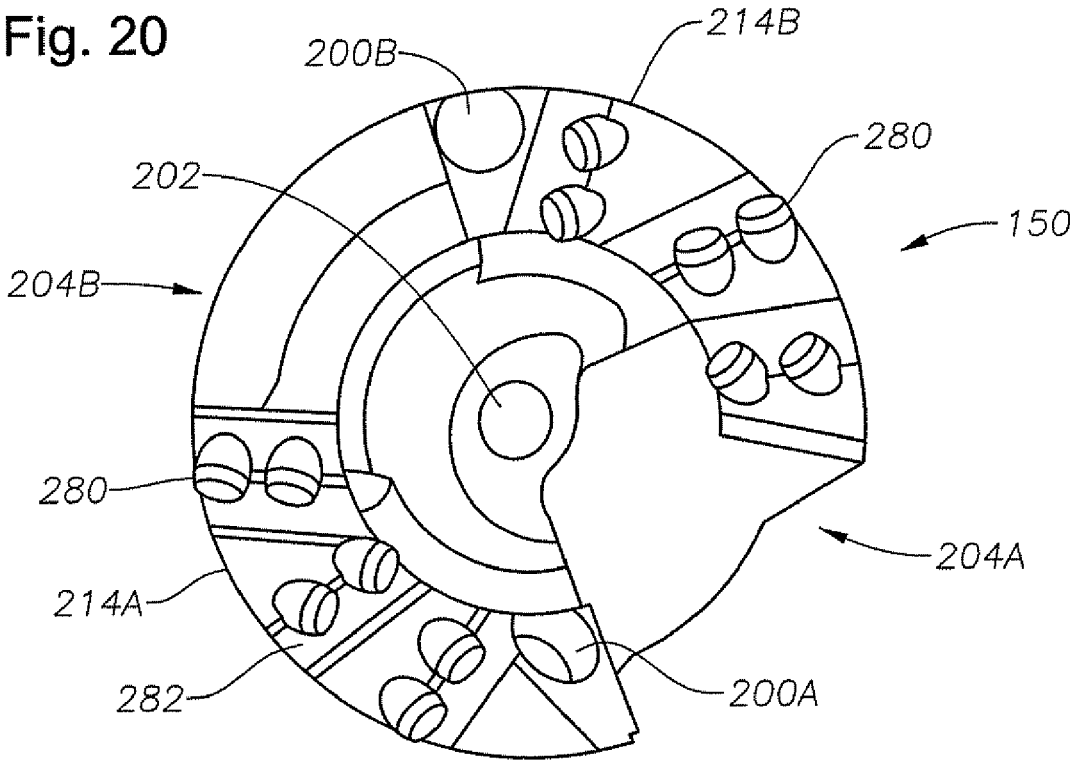
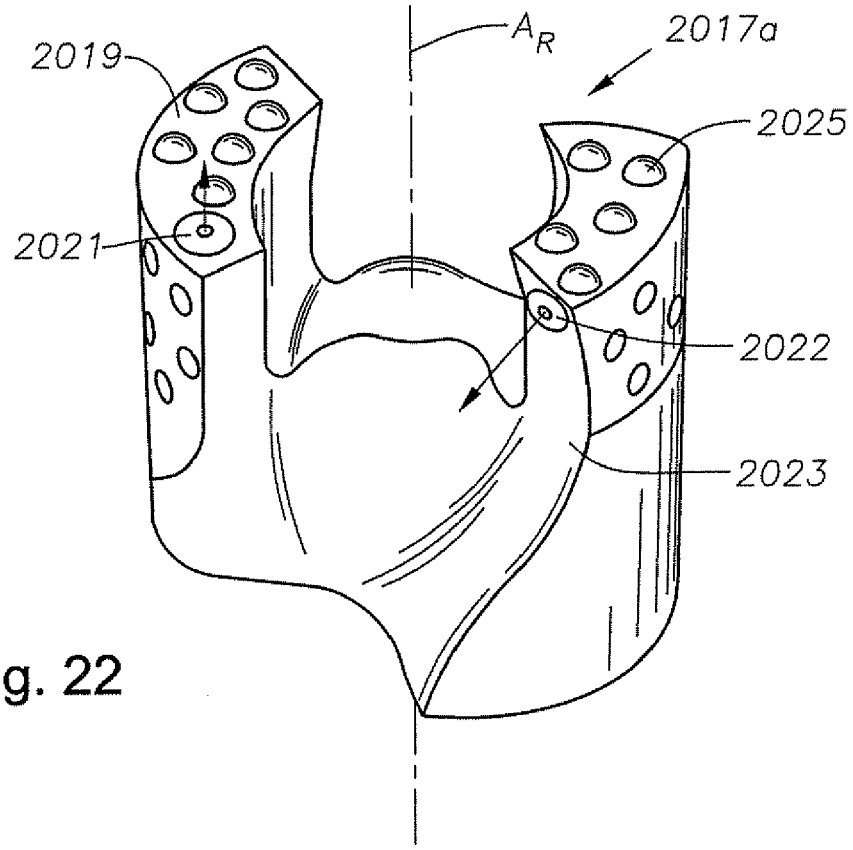
Fig. 22

METHODS OF USING A PARTICLE IMPACT DRILLING SYSTEM FOR REMOVING NEAR-BOREHOLE DAMAGE, MILLING OBJECTS IN A WELLBORE, UNDER REAMING, CORING, PERFORATING, ASSISTING ANNULAR FLOW, AND ASSOCIATED METHODS

CROSS-REFERENCE TO RELATED APPLICATIONS

This application is a divisional application that claims priority to and the benefit of co-pending U.S. application Ser. No. 12/363,022, filed Jan. 30, 2009, which is a non-provisional application that claims priority to and the benefit of U.S. Provisional App. No. 61/025,589, filed Feb. 1, 2008, each of the full disclosures of which is hereby incorporated by reference herein. This application is related by incorporation of U.S. Provisional App. No. 61/025,589, filed Feb. 1, 2008, to Provisional App. No. 60/463,903, filed Apr. 16, 2003; application Ser. No. 09/665,586 filed Sep. 19, 2000, now U.S. Pat. No. 6,386,300, issued May 14, 2002; application Ser. No. 10/097,038 filed Mar. 12, 2002, now U.S. Pat. No. 6,581,700, issued Jun. 24, 2003; application Ser. No. 10/897,169 filed Jul. 22, 2004, now U.S. Pat. No. 7,503,407, issued Mar. 17, 2009; application Ser. No. 11/204,981 filed August 2005, now U.S. Pat. No. 7,398,838, issued Jul. 15, 2008; application Ser. No. 11/204,436 filed Aug. 16, 2005, now U.S. Pat. No. 7,343,987, issued Mar. 18, 2008; application Ser. No. 11/204,862 filed Aug. 16, 2005, now U.S. Pat. No. 7,909,116, issued Mar. 22, 2011; application Ser. No. 11/205,006, filed Aug. 16, 2005, now U.S. Pat. No. 7,793,741, issued Sep. 14, 2010; application Ser. No. 11/204,772, filed Aug. 15, 2005; application Ser. No. 11/204,442 filed Aug. 16, 2005, now U.S. Pat. No. 7,398,839, issued Jul. 15, 2008; application Ser. No. 10/825,338 filed Apr. 15, 2004, now U.S. Pat. No. 7,258,176, issued Aug. 21, 2007; application Ser. No. 10/558,181, filed May 14, 2004; application Ser. No. 11/344,805 filed Feb. 1, 2006, now U.S. Pat. No. 7,798,249, issued Sep. 21, 2010; application Ser. No. 11/801,268, filed May 9, 2007; Provisional App. No. 60/899,135, filed Feb. 2, 2007; application Ser. No. 11/773,355 filed Jul. 3, 2007, now U.S. Pat. No. 7,997,355, issued Aug. 16, 2011; Provisional App. No. 60/959,207, filed Jul. 12, 2007, and Provisional App. No. 60/978,653, filed Oct. 9, 2007, each of the disclosures of which is incorporated herein by reference.

BACKGROUND

This disclosure generally relates to a system and method for injecting particles into a flow region in connection with, for example, excavating a formation. The formation may be excavated in order to, for example form a wellbore for the purpose of oil and gas recovery, construct a tunnel, or form other excavations in which the formation is cut, milled, pulverized, scraped, sheared, indented, and/or fractured, hereinafter referred to collectively as cutting.

SUMMARY OF THE INVENTION

Disclosed herein is a method of milling an object in a wellbore. In an embodiment the milling method includes providing in the wellbore a drill string and a drill bit with nozzles thereon that are in fluid communication with the drill string, flowing a mixture of impactors and pressurized circulating fluid within the drill string so that the impactors in the mixture exit the nozzles with sufficient energy to structurally alter the object when contacting the object, and eroding the object by directing at least one of the nozzles at the object while impactors exit the at least one nozzle so that the exiting impactors contact and structurally alter the object. Continuing eroding the object until the object is removed from the wellbore defines milling the object. The object can be casing lining the wellbore, a drill bit attached to casing used to bore the wellbore, or any other object in the wellbore. The bit can be rotated by ejecting pressurized fluid from a nozzle on the bit in a direction lateral to and offset from the bit axis. The drill bit can be replaced with a cutting member, where the cutting member can be a bit, a mill, a lead mill, a modified bit, or a modified mill.

Also disclosed is a wellbore under reamer apparatus having a drill string, a bit in fluid communication with the drill string, at least one nozzle in fluid communication with the drill string, a mixture of a pressurized circulating fluid and a plurality of impactors flowing in the drill string and exiting the nozzle, the nozzle exit directed lateral to the drill string so that when the drill string and nozzle is disposed in a wellbore that intersects a formation, the exiting impactors contact the formation with sufficient energy to structurally alter the formation and increase the wellbore diameter. A nozzle can be on the drill string, drill bit, or a nozzle can be on the string with an additional nozzle on the bit.

Additionally disclosed herein is a method of increasing the diameter of a borehole that intersects a formation. This method includes providing in the borehole a drill string and a nozzle that is in fluid communication with the drill string and flowing a mixture of impactors and pressurized circulating fluid through the drill string and to the nozzle so that the impactors exit the nozzle and contact the borehole circumference with sufficient energy to compress and structurally alter the formation thereby eroding formation at the borehole circumference to widen the borehole.

The present disclosure also includes a method of treating a circumference wall of a borehole. Treating can involve providing in the borehole a drill string and a nozzle that is in fluid communication with the drill string and selectively removing an identified portion of the borehole wall by flowing a mixture of impactors and pressurized circulating fluid through the drill string and to the nozzle so that the impactors exit the nozzle and contact the identified portion of the borehole wall with sufficient energy to compress and structurally alter the identified portion thereby eroding away the identified portion in the borehole. Filtercake and near wellbore formation damage can be removed with this method. Additionally, borehole wall permeability can be increased by removing the identified portion.

Described herein is a method of enhancing the flow of a drilling fluid in the annulus between a wellbore and a drill string. An embodiment of this method includes excavating a wellbore with a drilling system having a bit disposed on the end of a drill string and a nozzle, directing pressurized drilling fluid into the drill string to deliver to the drill bit, the pressurized drilling fluid being positioned to exit the system and flow up the wellbore, the nozzle being in fluid communication with the drill string and the pressurized drilling fluid, and selectively discharging pressurized drilling fluid from that nozzle into the annulus at localized lower pressure regions to perturb the regions and promote annular flow of drilling fluid along the wellbore. A nozzle can be on the drill string, drill bit, or a nozzle can be on the string with an additional nozzle on the bit.

The present disclosure further includes description of a device to retrieve core samples from a subterranean formation. The device can include an annular body, a nozzle, and a mixture of impactors and pressurized circulating fluid in selective fluid communication with the nozzle, so that flowing the mixture through the nozzle and directing the nozzle at the formation discharges impactors from the nozzle with sufficient energy to cut a core sample in the formation receivable in the annular body by compressing and structurally altering the formation. Additional nozzles can be included that are arranged to form a core sample insertable within the annular body.

A method of retrieving a core sample from a subterranean formation is described that includes providing an annular coring device and at least one nozzle in a wellbore that intersects the formation, discharging a mixture of impactors and pressurized circulating fluid from the nozzle to form a stream, directing the stream to the subterranean formation so that the impactors in the stream contact the formation with sufficient energy to compress and alter its structure thereby removing formation in a zone surrounding impactor contact, cutting a kerf in the formation with the stream thereby defining an outer peripheral surface of a core sample, and removing the core sample with the coring device. Coring can be on a wellbore sidewall or bottom hole.

Additionally described herein is a method of perforating a subterranean formation that includes providing a nozzle in a wellbore that intersects the formation, flowing a mixture of impactors and pressurized circulating fluid to the nozzle, discharging the mixture from the nozzle to form a stream, and directing the stream at the formation, so that the impactors in the stream contact the formation with sufficient energy to compress and alter its structure thereby removing formation to form a perforation in the formation. The nozzle can be relocated to other locations within the wellbore and additional perforations made at the other locations. A second nozzle can be included for perforating. The nozzle can be selectively extended into the formation thereby increasing the perforation depth.

BRIEF DESCRIPTION OF THE DRAWINGS

So that the manner in which the features and benefits of the invention, as well as others which will become apparent, may be understood in more detail, a more particular description of the embodiments of the invention may be had by reference to the embodiments thereof which are illustrated in the appended drawings, which form a part of this specification. It is also to be noted, however, that the drawings illustrate only various embodiments of the invention and are therefore not to be considered limiting of the invention's scope as it may include other effective embodiments as well.

FIG. 2 is a schematic diagram of an impactor impacted with a formation according to an embodiment of the present invention.

FIG. 3 is a schematic diagram of an impactor embedded into the formation at an angle to a normalized surface plane of the target formation according to an embodiment of the present invention.

FIG. 4 is a schematic diagram of an impactor impacting formation with plurality of fractures induced by the impact according to an embodiment of the present invention.

FIG. 13 is a canted top perspective view of the first embodiment of a drill bit of FIG. 5 according to the present invention.

FIG. 14 is a perspective environmental view of the first embodiment of a drill bit of FIG. 5 engaged in a well bore and having portions thereof cut away for clarity according to the present invention.

FIG. 20 is an end elevational view of the alternative embodiment of a drill bit of FIG. 18 according to the present invention.

FIG. 22 is a perspective view of an embodiment of the drill bit of FIG. 21 according to the present invention.

DETAILED DESCRIPTION

Figure 1:
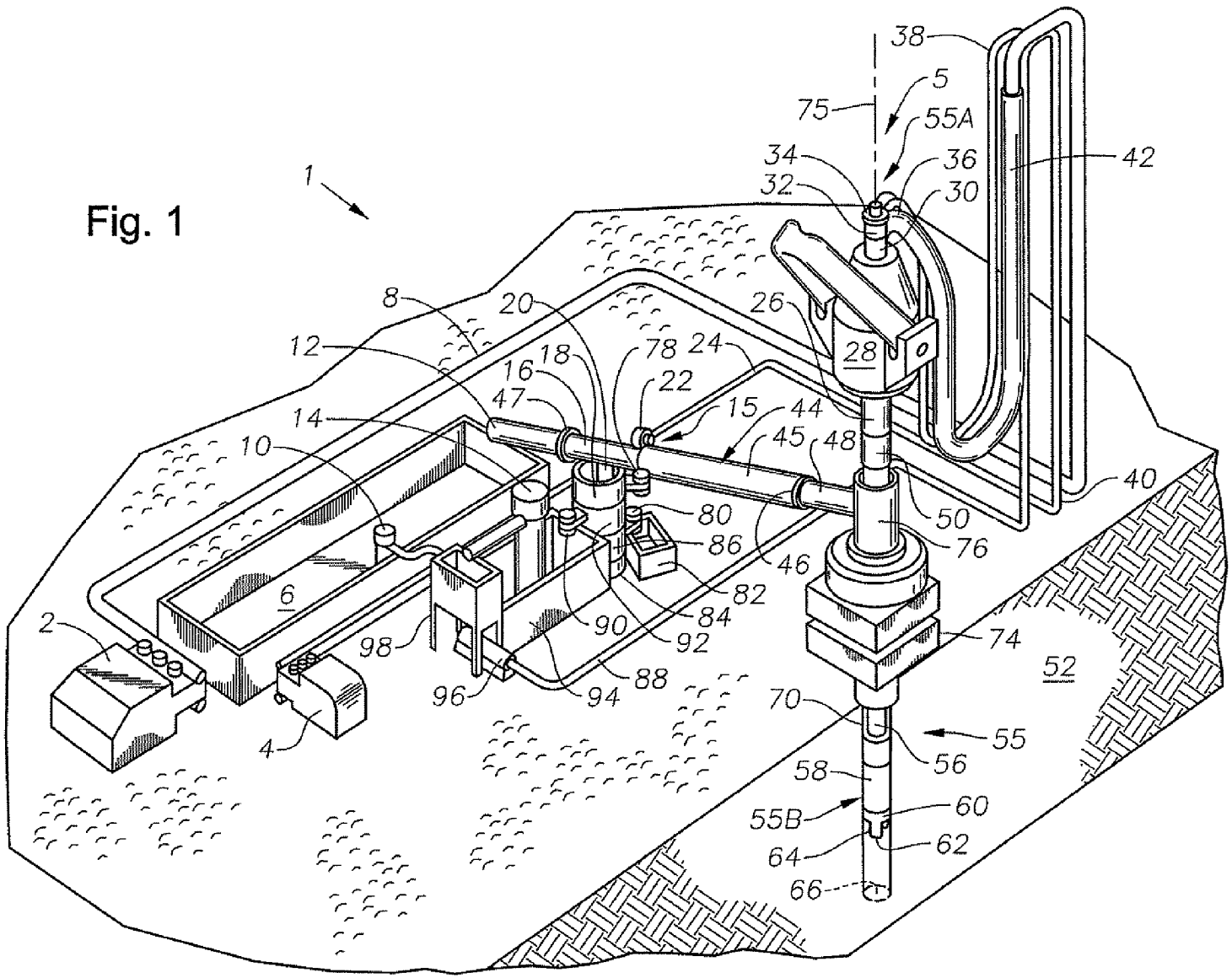
FIG. 1 is an isometric view of an excavation system position in an excavation environment according to an embodiment of the present invention.

In the drawings and description that follows, like parts are marked throughout the specification and drawings with the same reference numerals, respectively. The drawings are not necessarily to scale. Certain features of the disclosure may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results. The various characteristics mentioned above, as well as other features and characteristics described in more detail below, will be readily apparent to those skilled in the art upon reading the following detailed description of the embodiments, and by referring to the accompanying drawings.

Particle Impact Drilling System and Delivery Overview

An overview of embodiments of a Particle Impact Drilling (PID) system and associated methods of delivery of particle impactors for use in subterranean excavation is shown in FIGS. 1-20 and as will be described further herein. For example, FIGS. 1 and 2 illustrate an embodiment of an excavation system 1 including the use of solid material particles, or impactors, 100 to engage and excavate a subterranean formation 52 to create a wellbore 70. The excavation system 1, for example, may include a pipe string 55 having a plurality of collars 58, one or more pipes 56, and a kelly 50. An upper end of the kelly 50 may interconnect with a lower end of a swivel quill 26 as understood by those skilled in the art. An upper end of the swivel quill 26 may be rotatably interconnected with a swivel 28. The swivel 28 may include a top drive assembly (not shown) to rotate the pipe string 55. Alternatively, for example, the excavation system 1 may further include a body member, such as a drill bit 60, to cut the formation 52 in cooperation with the solid material impactors 100. The drill bit 60 may be attached to the lower end 55B of the pipe string 55 and may engage a bottom surface 66 of the wellbore 70. The drill bit 60 may be a roller cone bit, a fixed cutter bit, an impact bit, a spade bit, a mill, an impregnated bit, a natural diamond bit, or other suitable implement for cutting rock or earthen formation.

As illustrated in FIG. 1, the pipe string 55 may include a feed, or upper end 55A located substantially near an excavation rig 5 and a lower end 55B including a nozzle 64 supported thereon. The lower end 55B of the string 55 may include the drill bit 60 supported thereon. The excavation system 1 is not limited to excavating a wellbore 70. The excavation system and method may also be applicable to excavating a tunnel, a pipe chase, a mining operation, or other excavation operation so that earthen material or formation may be removed.

In another exemplary embodiment, the present system may be used to inject any solid particulate material into a wellbore. Exemplary particles may be magnetic or non-magnetic solid particles. Exemplary uses of the present system include, but are not limited to, easing exits.

To excavate the wellbore 70, the swivel 28, the swivel quill 26, the kelly 50, the pipe string 55, and a portion of the drill bit 60, if used, may each include an interior passage that allows circulation fluid to circulate through each of the aforementioned components. The circulation fluid may be withdrawn from a tank 6, pumped by a pump 2, through a through medium pressure capacity line 8, through a medium pressure capacity flexible hose 42, through a gooseneck 36, through the swivel 28, through the swivel quill 26, through the kelly 50, through the pipe string 55, and through the bit 60.

The excavation system 1 further has at least one nozzle 64 on the lower end 55B of the pipe string 55 for accelerating one or more solid material impactors 100 as the impactors 100 exit the pipe string 100. The nozzle 64 is designed to accommodate the impactors 100, such as an especially hardened nozzle, a shaped nozzle, or an "impactor" nozzle, which may be particularly adapted to a particular application. The nozzle 64 may be a type that is known and commonly available. The nozzle 64 may further be selected to accommodate the impactors 100 in a selected size range or of a selected material composition. Nozzle size, type, material, and quantity may be a function of the formation being cut, fluid properties, impactor properties, and/or desired hydraulic energy expenditure at the nozzle 64. If a drill bit 60 is used, the nozzle or nozzles 64 may be located in the drill bit 60.

The nozzle 64 may alternatively be a conventional dual-discharge nozzle as understood by those skilled in the art. Such dual discharge nozzles may generate: (1) a radially outer circulation fluid jet substantially encircling a jet axis, and/or (2) an axial circulation fluid jet substantially aligned with and coaxial with the jet axis, with the dual discharge nozzle directing a majority by weight of the plurality of solid material impactors into the axial circulation fluid jet. A dual discharge nozzle 64 may separate a first portion of the circulation fluid flowing through the nozzle 64 into a first circulation fluid stream having a first circulation fluid exit nozzle velocity, and a second portion of the circulation fluid flowing through the nozzle 64 into a second circulation fluid stream having a second circulation fluid exit nozzle velocity lower than the first circulation fluid exit nozzle velocity. The plurality-of solid material impactors 100 may be directed into the first circulation fluid stream such that a velocity of the plurality of solid material impactors 100 while exiting the nozzle 64 is substantially greater than a velocity of the circulation fluid while passing through a nominal diameter flow path in the lower end 55B of the pipe string 55, to accelerate the solid material impactors 100.

Each of the individual impactors 100 is structurally independent from the other impactors. For brevity, the plurality of solid material impactors 100 may be interchangeably referred to as simply the impactors 100. The plurality of solid material impactors 100 may be substantially rounded and have either a substantially non-uniform outer diameter or a substantially uniform outer diameter. For example, the solid material impactors 100 may be substantially spherically shaped, non-hollow, and formed of rigid metallic material, and the impactors 100 may have high compressive strength and crush resistance, such as steel shot, ceramics, depleted uranium, and multiple component materials. Although the solid material impactors 100 may be substantially a non-hollow sphere, alternative embodiments may provide for other types of solid material impactors, which may include impactors 100 with a hollow interior. The impactors may be magnetic or non-magnetic. The impactors may be substantially rigid and may possess relatively high compressive strength and resistance to crushing or deformation as compared to physical properties or rock properties of a particular formation or group of formations being penetrated by the wellbore 70.

The impactors may be of a substantially uniform mass, grading, or size. The solid material impactors 100 may have any suitable density for use in the excavation system 1. For example, the solid material impactors 100 may have an average density of at least 470 pounds per cubic foot.

Alternatively, the solid material impactors 100 may include other metallic materials, including tungsten carbide, copper, iron, or various combinations or alloys of these and other metallic compounds. The impactors 100 may also be composed of non-metallic materials, such as ceramics, or other man-made or substantially naturally occurring non-metallic materials. Also, the impactors 100 may be crystalline shaped, angular shaped, sub-angular shaped, selectively shaped, such as like a torpedo, dart, rectangular, or otherwise generally non-spherically shaped.

The impactors 100 may be selectively introduced into a fluid circulation system, such as illustrated in FIG. 1, near an excavation rig 5, circulated with the circulation fluid (or "mud"), and accelerated through at least one nozzle 64. "At the excavation rig" or "near an excavation rig" may also include substantially remote separation, such as a separation process that may be at least partially carried out on the sea floor.

Introducing the impactors 100 into the circulation fluid may be accomplished by any of several known techniques. For example, the impactors 100 may be provided in an impactor storage tank 94 near the rig 5 or in a storage bin 82. A screw elevator 14 may then transfer a portion of the impactors at a selected rate from the storage tank 94, into a slurrification tank 98. A pump 10, as understood by those skilled in the art, such as a progressive cavity pump, may transfer a selected portion of the circulation fluid from a mud tank 6, into the slurrification tank 98 to be mixed with the impactors 100 in the tank 98 to form an impactor concentrated slurry. An impactor introducer 96 may be included to pump or introduce a plurality of solid material impactors 100 into the circulation fluid before circulating a plurality of impactors 100 and the circulation fluid to the nozzle 64. The impactor introducer 96, for example, may be a progressive cavity pump capable of pumping the impactor concentrated slurry at a selected rate and pressure through a slurry line 88, through a slurry hose 38, through an impactor slurry injector head 34, and through an injector port 30 located on the gooseneck 36, which may be located atop the swivel 28. The swivel 28, including the through bore for conducting circulation fluid therein, may be substantially supported on the feed, or upper, end of the pipe string 55 for conducting circulation fluid from the gooseneck 36 into the latter end 55*a*. The upper end 55A of the pipe string 55 may also include the kelly 50 to connect the pipe 56 with the swivel quill 26 and/or the swivel 28. The circulation fluid may also be provided with rheological properties sufficient to adequately transport and/or suspend the plurality of solid material impactors 100 within the circulation fluid.

The solid material impactors 100 may also be introduced into the circulation fluid by withdrawing the plurality of solid material impactors 100 from a low pressure impactor source 98 into a high velocity stream of circulation fluid, such as by venturi effect. For example, when introducing impactors 100 into the circulation fluid, the rate of circulation fluid pumped by the mud pump 2 may be reduced to a rate lower than the mud pump 2 is capable of efficiently pumping. In such event, a lower volume mud pump 4 may pump the circulation fluid through a medium pressure capacity line 24 and through the medium pressure capacity flexible hose 40.

The circulation fluid may be circulated from the fluid pump 2 and/or 4, such as a positive displacement type fluid pump, through one or more fluid conduits 8, 24, 40, 42, into the pipe string 55. The circulation fluid may then be circulated through the pipe string 55 and through the nozzle 64. The circulation fluid may be pumped at a selected circulation rate and/or a selected pump pressure to achieve a desired impactor and/or fluid energy at the nozzle 64.

The pump 4 may also serve as a supply pump to drive the introduction of the impactors 100 entrained within an impactor slurry, into the high pressure circulation fluid stream pumped by and pumps 2 and 4. Pump 4 may pump a percentage of the total rate of fluid being pumped by both pumps 2 and 4, such that the circulation fluid pumped by pump 4 may create a venturi effect and/or vortex within the injector head 34 that inducts the impactor slurry being conducted through the line 42, through the injector head 34, and then into the high pressure circulation fluid stream.

From the swivel 28, the slurry of circulation fluid and impactors may circulate through the interior passage in the pipe string 55 and through the nozzle 64. As described above, the nozzle 64 may alternatively be at least partially located in the drill bit 60. Each nozzle 64 may include a reduced inner diameter as compared to an inner diameter of the interior passage in the pipe string 55 immediately above the nozzle 64. Thereby, each nozzle 64 may accelerate the velocity of the slurry as the slurry passes through the nozzle 64. The nozzle 64 may also direct the slurry into engagement with a selected portion of the bottom surface 66 of wellbore 70. The nozzle 64 may also be rotated relative to the formation 52 depending on the excavation parameters. To rotate the nozzle 64, the entire pipe string 55 may be rotated or only the nozzle 64 on the end of the pipe string 55 may be rotated while the pipe string 55 is not rotated. Rotating the nozzle 64 may also include oscillating the nozzle 64 rotationally back and forth as well as vertically, and may further include rotating the nozzle 64 in discrete increments. The nozzle 64 may also be maintained rotationally substantially stationary.

The circulation fluid may be substantially continuously circulated during excavation operations to circulate at least some of the plurality of solid material impactors 100 and the formation cuttings away from the nozzle 64. The impactors 100 and fluid circulated away from the nozzle 64 may be circulated substantially back to the excavation rig 5, or circulated to a substantially intermediate position between the excavation rig 5 and the nozzle 64.

If the drill bit 60 is used, the drill bit 60 may be rotated relative to the formation 52 and engaged therewith by axial force (WOB) acting at least partially along the wellbore axis 75 near the drill bit 60. The bit 60 may also include a plurality of bit cones 62, which also may rotate relative to the bit 60 to cause bit teeth secured to a respective cone to engage the formation 52, which may generate formation cuttings substantially by crushing, cutting, or pulverizing a portion of the formation 52. The bit 60 may also be formed of a fixed cutting structure that may be substantially continuously engaged with the formation 52 and create cuttings primarily by shearing and/or axial force concentration to fail the formation, or create cuttings from the formation 52. To rotate the bit 60, the entire pipe string 55 may be rotated or only the bit 60 on the end of the pipe string 55 may be rotated while the pipe string 55 is not rotated. Rotating the drill bit 60 may also include oscillating the drill bit 60 rotationally back and forth as well as vertically, and may further include rotating the drill bit 60 in discrete increments.

Also alternatively, the excavation system 1 may include a pump, such as a centrifugal pump, having a resilient lining that is compatible for pumping a solid material laden slurry. The pump may pressurize the slurry to a pressure greater than the selected mud pump pressure to pump the plurality of solid material impactors 100 into the circulation fluid. The impactors 100 may be introduced through an impactor injection port, such as port 30. Other alternative embodiments for the system 1 may include an impactor injector for introducing the plurality of solid material impactors 100 into the circulation fluid.

As the slurry is pumped through the pipe string 55 and out the nozzles 64, the impactors 100 may engage the formation with sufficient energy to enhance the rate of formation removal or penetration (ROP). The removed portions of the formation may be circulated from within the wellbore 70 near the nozzle 64, and carried suspended in the fluid with at least a portion of the impactors 100, through a wellbore annulus between the OD of the pipe string 55 and the ID of the wellbore 70.

At the excavation rig 5, the returning slurry of circulation fluid, formation fluids (if any), cuttings, and impactors 100 may be diverted at a nipple 76, which may be positioned on a BOP stack 74. The returning slurry may flow from the nipple 76, into a return flow line 15, which may include tubes 48, 45, 16, 12 and flanges 46, 47. The return line 15 may include an impactor reclamation tube assembly 44, as illustrated in FIG. 1, which may preliminarily separate a majority of the returning impactors 100 from the remaining components of the returning slurry to salvage the circulation fluid for recirculation into the present wellbore 70 or another wellbore. At least a portion of the impactors 100 may be separated from a portion of the cuttings by a series of screening devices, such as the vibrating classifiers 84, as understood by those skilled in the art, to salvage a reusable portion of the impactors 100 for reuse to re-engage the formation 52. A majority of the cuttings and a majority of non-reusable impactors 100 may also be discarded.

The reclamation tube assembly 44 may operate by rotating tube 45 relative to tube 16. An electric motor assembly 22 may rotate tube 44. The reclamation tube assembly 44 includes an enlarged tubular 45 section to reduce the return flow slurry velocity and allow the slurry to drop below a terminal velocity of the impactors 100, such that the impactors 100 can no longer be suspended in the circulation fluid and may gravitate to a bottom portion of the tube 45. This separation function may be enhanced by placement of magnets near and along a lower side of the tube 45. The impactors 100 and some of the larger or heavier cuttings may be discharged through discharge port 20. The separated and discharged impactors 100 and solids discharged through discharge port 20 may be gravitationally diverted into a vibrating classifier 84 or may be pumped into the classifier 84. A pump (not shown) capable of handling impactors and solids, such as a progressive cavity pump may be situated in communication with the flow line discharge port 20 to conduct the separated impactors 100 selectively into the vibrating separator 84 or elsewhere in the circulation fluid circulation system.

In an exemplary embodiment, the return flow line 15, which as noted previously may include tubes 48, 45, 16, 12 and flanges 46 and 47, may also include a vibrational source, such as for example, a variable amplitude, variable frequency vibrator. Exemplary vibrational devices include those produced by Eriez Magnetics, such as for example, a variable amplitude, variable frequency vibrator, although similar devices produced by other manufactures may also be used as understood by those skilled in the art. Employing such a vibrational device may help to prevent solid material impactors, drill cuttings and other particulate materials from forming "beaches" in the return flow line wherein solid masses of particulate material can form stagnate agglomerations. Additionally, the use of vibrational devices may also assist with the process of the return flow line carrying shot and drill cuttings from the annulus of the wellbore to the process equipment. In some exemplary embodiments, a plurality of vibrational devices may be employed in the return flow line(s) to prevent the accumulation of particles.

In another exemplary embodiment, movement of particles in the return flow line may be assisted by the addition of a lubricant. The lubricant can be water, oil, a polymer solution, or any other liquid lubricant, and can be dispersed from a source directly into the slurry flow of drilling fluids and solid material particles and/or particulate material. In an exemplary embodiment, the lubricant may be supplied to the slurry flow through a circumferential passage located, for example, at a flange connection, as described for example in U.S. Pat. No. 5,479,957, the disclosure of which is incorporated by reference in its entirety. An exemplary embodiment includes the Pipeline Lubrication System manufactured by Schwing Bioset, Inc. of Somerset, Wis. Injection of the lubricant can be done upstream of the wellbore, during the addition of the solid material impactors, or downstream of the wellbore, such as for example, in the return flow line. In certain embodiments, the lubricant may be directly added to the drilling fluids. In certain embodiments, the lubricant may be removed from the drilling fluids prior to the drilling fluids being recycled.

The vibrating classifier 84 may include a three-screen section classifier of which screen section 18 may remove the coarsest grade material. The removed coarsest grade material may be selectively directed by outlet 78 to one of storage bin 82 or pumped back into the flow line 15 downstream of discharge port 20. A second screen section 92 may remove a re-usable grade of impactors 100, which in turn may be directed by outlet 90 to the impactor storage tank 94. A third screen section 86 may remove the finest grade material from the circulation fluid. The removed finest grade material may be selectively directed by outlet 80 to storage bin 82, or pumped back into the flow line 15 at a point downstream of discharge port 20. Circulation fluid collected in a lower portion of the classified 84 may be returned to a mud tank 6 for re-use.

The circulation fluid may be recovered for recirculation in a wellbore or the circulation fluid may be a fluid that is substantially not recovered. The circulation fluid may be a liquid, gas, foam, mist, or other substantially continuous or multiphase fluid. For recovery, the circulation fluid and other components entrained within the circulation fluid may be directed across a shale shaker (not shown) or into a mud tank 6, whereby the circulation fluid may be further processed by techniques known in the art for re-circulation into a wellbore.

The excavation system 1 creates a mass-velocity relationship in a plurality of the solid material impactors 100, such that an impactor 100 may have sufficient energy to structurally alter the formation 52 in a zone of a point of impact. The mass-velocity relationship may be satisfied as sufficient when a substantial portion by weight of the solid material impactors 100 may by virtue of their mass and velocity at the exit of the nozzle 64, create a structural alteration as claimed or disclosed herein. Impactor velocity to achieve a desired effect upon a given formation may vary as a function of formation compressive strength, hardness, or other rock properties, and as a function of impactor size and circulation fluid rheological properties. A substantial portion means at least five percent by weight of the plurality of solid material impactors that are introduced into the circulation fluid.

The impactors 100 for a given velocity and mass of a substantial portion by weight of the impactors 100 are subject to the following mass-velocity relationship. The resulting kinetic energy of at least one impactor 100 exiting a nozzle 64 is at least 0.075 ft-lbs or has a minimum momentum of 0.0003 (ft-lbs.)/(sec).

Kinetic energy is quantified by the relationship of an object's mass and its velocity. The quantity of kinetic energy associated with an object is calculated by multiplying its mass times its velocity squared. To reach a minimum value of kinetic energy in the mass-velocity relationship as defined, small particles such as those found in abrasives and grits, must have a significantly high velocity due to the small mass of the particle. A large particle, however, needs only moderate velocity to reach an equivalent kinetic energy of the small particle because its mass may be several orders of magnitude larger.

The velocity of a substantial portion by weight of the plurality of solid material impactors 100 immediately exiting a nozzle 64 may be as slow as 100 feet per second and as fast as 1000 feet per second, immediately upon exiting the nozzle 64.

The velocity of a majority by weight of the impactors 100 may be substantially the same, or only slightly reduced, at the point of impact of an impactor 100 at the formation surface 66 as compared to when leaving the nozzle 64. Thus, it may be appreciated by those skilled in the art that due to the close proximity of a nozzle 64 to the formation being impacted, the velocity of a majority of impactors 100 exiting a nozzle 64 may be substantially the same as a velocity of an impactor 100 at a point of impact with the formation 52. Therefore, in many practical applications, the above velocity values may be determined or measured at substantially any point along the path between near an exit end of a nozzle 64 and the point of impact, without material deviation from the scope of this disclosure.

In addition to the impactors 100 satisfying the mass-velocity relationship described above, a substantial portion by weight of the solid material impactors 100 have an average mean diameter of between approximately 0.050 to 0.500 of an inch.

To excavate a formation 52, the excavation implement, such as a drill bit 60 or impactor 100, must overcome minimum, in-situ stress levels or toughness of the formation 52. These minimum stress levels are known to typically range from a few thousand pounds per square inch, to in excess of 65,000 pounds per square inch. To fracture, cut, or plastically deform a portion of formation 52, force exerted on that portion of the formation 52 typically should exceed the minimum, in-situ stress threshold of the formation 52. When an impactor 100 first initiates contact with a formation, the unit stress exerted upon the initial contact point may be much higher than 10,000 pounds per square inch, and may be well in excess of one million pounds per square inch. The stress applied to the formation 52 during contact is governed by the force the impactor 100 contacts the formation with and the area of contact of the impactor with the formation. The stress is the force divided by the area of contact. The force is governed by Impulse Momentum theory, as understood by those skilled in the art, whereby the time at which the contact occurs determines the magnitude of the force applied to the area of contact. In cases where the particle is contacting a relatively hard surface at an elevated velocity, the force of the particle when in contact with the surface is not constant, but is better described as a spike. The force, however, need not be limited to any specific amplitude or duration. The magnitude of the spike load can be very large and occur in just a small fraction of the total impact time. If the area of contact is small the unit stress can reach values many times in excess of the in situ failure stress of the rock, thus guaranteeing fracture initiation and propagation and structurally altering the formation 52.

A substantial portion by weight of the solid material impactors 100 may apply at least 5000 pounds per square inch of unit stress to a formation 52 to create the structurally altered zone Z in the formation. The structurally altered zone Z is not limited to any specific shape or size, including depth or width. Further, a substantial portion by weight of the impactors 100 may apply in excess of 20,000 pounds per square inch of unit stress to the formation 52 to create the structurally altered zone Z in the formation. The mass-velocity relationship of a substantial portion by weight of the plurality of solid material impactors 100 may also provide at least 30,000 pounds per square inch of unit stress.

A substantial portion by weight of the solid material impactors 100 may have any appropriate velocity to satisfy the mass-velocity relationship. For example, a substantial portion by weight of the solid material impactors may have a velocity of at least 100 feet per second when exiting the nozzle 64. A substantial portion by weight of the solid material impactors 100 may also have a velocity of at least 100 feet per second and as great as 1200 feet per second when exiting the nozzle 64. A substantial portion by weight of the solid material impactors 100 may also have a velocity of at least 100 feet per second and as great as 750 feet per second when exiting the nozzle 64. A substantial portion by weight of the solid material impactors 100 may also have a velocity of at least 350 feet per second and as great as 500 feet per second when exiting the nozzle 64.

Impactors 100 may be selected based upon physical factors such as size, projected velocity, impactor strength, formation 52 properties and desired impactor concentration in the circulation fluid. Such factors may also include; (a) an expenditure of a selected range of hydraulic horsepower across the one or more nozzles, (b) a selected range of circulation fluid velocities exiting the one or more nozzles or impacting the formation, and (c) a selected range of solid material impactor velocities exiting the one or more nozzles or impacting the formation, (d) one or more rock properties of the formation being excavated, or (e), any combination thereof.

If an impactor 100 is of a specific shape such as that of a dart, a tapered conic, a rhombic, an octahedral, or similar oblong shape, a reduced impact area to impactor mass ratio may be achieved. The shape of a substantial portion by weight of the impactors 100 may be altered, so long as the mass-velocity relationship remains sufficient to create a claimed structural alteration in the formation and an impactor 100 does not have any one length or diameter dimension greater than approximately 0.100 inches. Thereby, a velocity required to achieve a specific structural alteration may be reduced as compared to achieving a similar structural alteration by impactor shapes having a higher impact area to mass ratio. Shaped impactors 100 may be formed to substantially align themselves along a flow path, which may reduce variations in the angle of incidence between the impactor 100 and the formation 52. Such impactor shapes may also reduce impactor contact with the flow structures such those in the pipe string 55 and the excavation rig 5 and may thereby minimize abrasive erosion of flow conduits.

As illustrated in FIGS. 1-4, for example, a substantial portion by weight of the impactors 100 may engage the formation 52 with sufficient energy to enhance creation of a wellbore 70 through the formation 52 by any or a combination of different impact mechanisms. First, an impactor 100 may directly remove a larger portion of the formation 52 than may be removed by abrasive-type particles. In another mechanism, an impactor 100 may penetrate into the formation 52 without removing formation material from the formation 52. A plurality of such formation penetrations, such as near and along an outer perimeter of the wellbore 70 may relieve a portion of the stresses on a portion of formation being excavated, which may thereby enhance the excavation action of other impactors 100 or the drill bit 60. Third, an impactor 100 may alter one or more physical properties of the formation 52. Such physical alterations may include creation of micro-fractures and increased brittleness in a portion of the formation 52, which may thereby enhance effectiveness of the impactors 100 in excavating the formation 52. The constant scouring of the bottom of the borehole also prevents the build up of dynamic filtercake, which can significantly increase the apparent toughness of the formation 52.

FIG. 2 illustrates an impactor 100 that has been impaled into a formation 52, such as a lower surface 66 in a wellbore 70. For illustration purposes, the surface 66 is illustrated as substantially planar and transverse to the direction of impactor travel T. The impactors 100 circulated through a nozzle 64 may engage the formation 52 with sufficient energy to affect one or more properties of the formation 52.

A portion of the formation 52 ahead of the impactor 100 substantially in the direction of impactor travel T may be altered such as by micro-fracturing and/or thermal alteration due to the impact energy. In such occurrence, the structurally altered zone Z may include an altered zone depth D. An example of a structurally altered zone Z is a compressive zone Z1, which may be a zone in the formation 52 compressed by the impactor 100. The compressive zone Z1 may have a length L1, but is not limited to any specific shape or size. The compressive zone Z1 may be thermally altered due to impact energy.

An additional example of a structurally altered zone 102 near a point of impaction may be a zone of micro-fractures Z2. The structurally altered zone Z may be broken or otherwise altered due to the impactor 100 and/or a drill bit 60, such as by crushing, fracturing, or micro-fracturing.

FIG. 2 also illustrates an impactor 100 implanted into a formation 52 and having created an excavation E wherein material has been ejected from or crushed beneath the impactor 100. Thereby the excavation E may be created, which as illustrated in FIG. 3 may generally conform to the shape of the impactor 100.

FIGS. 3 and 4 illustrate excavations E where the size of the excavation may be larger than the size of the impactor 100. In FIG. 2, the impactor 100 is shown as impacted into the formation 52 yielding an excavation depth D.

An additional theory for impaction mechanics in cutting a formation 52 may postulate that certain formations 52 may be highly fractured or broken up by impactor energy. FIG. 4 illustrates an interaction between an impactor 100 and a formation 52. A plurality of fractures F and micro-fractures MF may be created in the formation 52 by impact energy.

An impactor 100 may penetrate a small distance into the formation 52 and cause the displaced or structurally altered formation 52 to "splay out" or be reduced to small enough particles for the particles to be removed or washed away by hydraulic action. Hydraulic particle removal may depend at least partially upon available hydraulic horsepower and at least partially upon particle wet-ability and viscosity. Such formation deformation may be a basis for fatigue failure of a portion of the formation by "impactor contact," as the plurality of solid material impactors 100 may displace formation material back and forth.

Each nozzle 64 may be selected to provide a desired circulation fluid circulation rate, hydraulic horsepower substantially at the nozzle 64, and/or impactor energy or velocity when exiting the nozzle 64. Each nozzle 64 may be selected as a function of at least one of (a) an expenditure of a selected range of hydraulic horsepower across the one or more nozzles 64, (b) a selected range of circulation fluid velocities exiting the one or more nozzles 64, and (c) a selected range of solid material impactor 100 velocities exiting the one or more nozzles 64.

To optimize rate of penetration (ROP), it may be desirable to determine, such as by monitoring, observing, calculating, knowing, or assuming one or more excavation parameters such that adjustments may be made in one or more controllable variables as a function of the determined or monitored excavation parameter. The one or more excavation parameters may be selected from a group including: (a) a rate of penetration into the formation 52, (b) a depth of penetration into the formation 52, (c) a formation excavation factor, and (d) the number of solid material impactors 100 introduced into the circulation fluid per unit of time. Monitoring or observing may include monitoring or observing one or more excavation parameters of a group of excavation parameters including: (a) rate of nozzle rotation, (b) rate of penetration into the formation 52, (c) depth of penetration into the formation 52, (d) formation excavation factor, (e) axial force applied to the drill bit 60, (f) rotational force applied to the bit 60, (g) the selected circulation rate, (h) the selected pump pressure, and/or (i) wellbore fluid dynamics, including pore pressure.

One or more controllable variables or parameters may be altered, including at least one of: (a) rate of impactor 100 introduction into the circulation fluid, (b) impactor 100 size, (c) impactor 100 velocity, (d) drill bit nozzle 64 selection, (e) the selected circulation rate of the circulation fluid, (f) the selected pump pressure, and (g) any of the monitored excavation parameters.

To alter the rate of impactors 100 engaging the formation 52, the rate of impactor 100 introduction into the circulation fluid may be altered. The circulation fluid circulation rate may also be altered independent from the rate of impactor 100 introduction. Thereby, the concentration of impactors 100 in the circulation fluid may be adjusted separate from the fluid circulation rate. Introducing a plurality of solid material impactors 100 into the circulation fluid may be a function of impactor 100 size, circulation fluid rate, nozzle rotational speed, wellbore 70 size, and a selected impactor 100 engagement rate with the formation 52. The impactors 100 may also be introduced into the circulation fluid intermittently during the excavation operation. The rate of impactor 100 introduction relative to the rate of circulation fluid circulation may also be adjusted or interrupted as desired.

The plurality of solid material impactors 100 may be introduced into the circulation fluid at a selected introduction rate and/or concentration to circulate the plurality of solid material impactors 100 with the circulation fluid through the nozzle 64. The selected circulation rate and/or pump pressure, and nozzle selection may be sufficient to expend a desired portion of energy or hydraulic horsepower in each of the circulation fluid and the impactors 100.

An example of an operative excavation system 1 may include a bit 60 with an 8½" inch bit diameter. The solid material impactors 100 may be introduced into the circulation fluid at a rate of 12 gallons per minute. The circulation fluid containing the solid material impactors may be circulated through the bit 60 at orate of 462 gallons per minute. A substantial portion by weight of the solid material impactors may have an average mean diameter of 0.100". The following parameters will result in a penetration rate of approximately 27 feet per hour into Sierra White Granite. In this example, the excavation system may produce 1413 solid material impactors 100 per cubic inch with approximately 3.9 million impacts per minute against the formation 52. On average, 0.00007822 cubic inches of the formation 52 are removed per impactor 100 impact. The resulting exit velocity of a substantial portion of the impactors 100 from each of the nozzles 64 would average 495.5 feet per second. The kinetic energy of a substantial portion by weight of the solid material impacts 100 would be approximately 1.14 ft-lbs., thus satisfying the mass-velocity relationship described above.

Another example of an operative excavation system 1 may include a bit 60 with an 8½ inch bit diameter. The solid material impactors 100 may be introduced into the circulation fluid at a rate of 12 gallons per minute. The circulation fluid containing the solid material impactors may be circulated through the nozzle 64 at a rate of 462 gallons per minute. A substantial portion by weight of the solid material impactors may have an average mean diameter of 0.075". The following parameters will result in approximately a 35 feet per hour penetration rate into Sierra White Granite. In this example, the excavation system 1 may produce 3350 solid material impactors 100 per cubic inch with approximately 9.3 million impacts per minute against the formation 52. On average, 0.0000428 cubic inches of the formation 52 are removed per impactor 100 impact. The resulting exit velocity of a substantial portion of the impactors 100 from each of the nozzles 64 would average 495.5 feet per second. The kinetic energy of a substantial portion by weight of the solid material impacts 100 would be approximately 0.240 Ft Lbs., thus satisfying the mass-velocity relationship described above.

In addition to impacting the formation with the impactors 100, the bit 60 may be rotated while circulating the circulation fluid and engaging the plurality of solid material impactors 100 substantially continuously or selectively intermittently. The nozzle 64 may also be oriented to cause the solid material impactors 100 to engage the formation 52 with a radially outer portion of the bottom hole surface 66. Thereby, as the drill bit 60 is rotated, the impactors 100, in the bottom hole surface 66 ahead of the bit 60, may create one or more circumferential kerfs. The drill bit 60 may thereby generate formation cuttings more efficiently due to reduced stress in the surface 66 being excavated, due to the one or more substantially circumferential kerfs in the surface 66.

The excavation system 1 may also include inputting pulses of energy in the fluid system sufficient to impart a portion of the input energy in an impactor 100. The impactor 100 may thereby engage the formation 52 with sufficient energy to achieve a structurally altered zone Z. Pulsing of the pressure of the circulation fluid in the pipe string 55, near the nozzle 64 also may enhance the ability of the circulation fluid to generate cuttings subsequent to impactor 100 engagement with the formation 52.

Each combination of formation type, bore hole size, bore hole depth, available weight on bit, bit rotational speed, pump rate, hydrostatic balance, circulation fluid rheology, bit type, and tooth/cutter dimensions may create many combinations of optimum impactor presence or concentration, and impactor energy requirements. The methods and systems of this disclosure facilitate adjusting impactor size, mass, introduction rate, circulation fluid rate and/or pump pressure, and other adjustable or controllable variables to determine and maintain an optimum combination of variables. The methods and systems of this disclosure also may be coupled with select bit nozzles, downhole tools, and fluid circulating and processing equipment to effect many variations in which to optimize rate of penetration.

Figure 5:
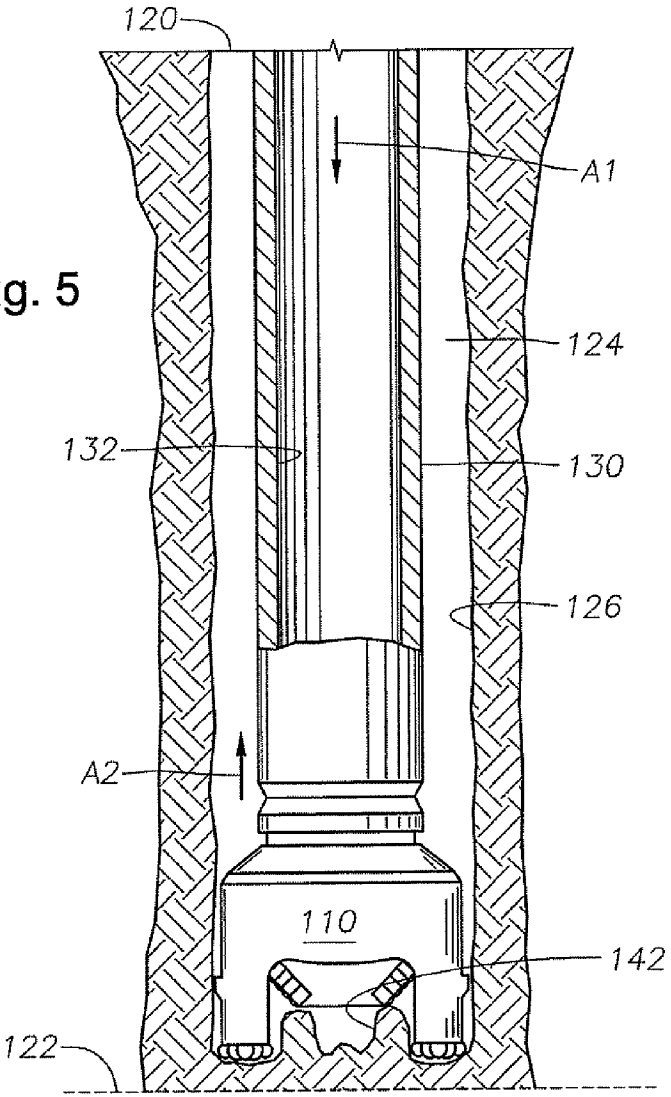
FIG. 5 is an elevational view of a drilling system in an excavation environment utilizing a first embodiment of a drill bit according to the present invention.

FIG. 5 shows an alternate embodiment of the drill bit 60 (FIG. 1) and is referred to, in general, by the reference numeral 110 and which is located at the bottom of a well bore 120 and attached to a drill string 130. The drill bit 110 acts upon a bottom surface 122 of the well bore 120. The drill string 130 has a central passage 132 that supplies drilling fluids to the drill bit 110 as shown by the arrow A1. The drill bit 110 uses the drilling fluids and solid material impactors 100 when acting upon the bottom surface 122 of the well bore 120. The drilling fluids then exit the well bore 120 through a well bore annulus 124 between the drill string 130 and the inner wall 126 of the well bore 120. Particles of the bottom surface 122 removed by the drill bit 110 exit the well bore 120 with the drilling fluid through the well bore annulus 124 as shown by the arrow A2. The drill bit 110 creates a rock ring 142 at the bottom surface 122 of the well bore 120.

Figure 6:
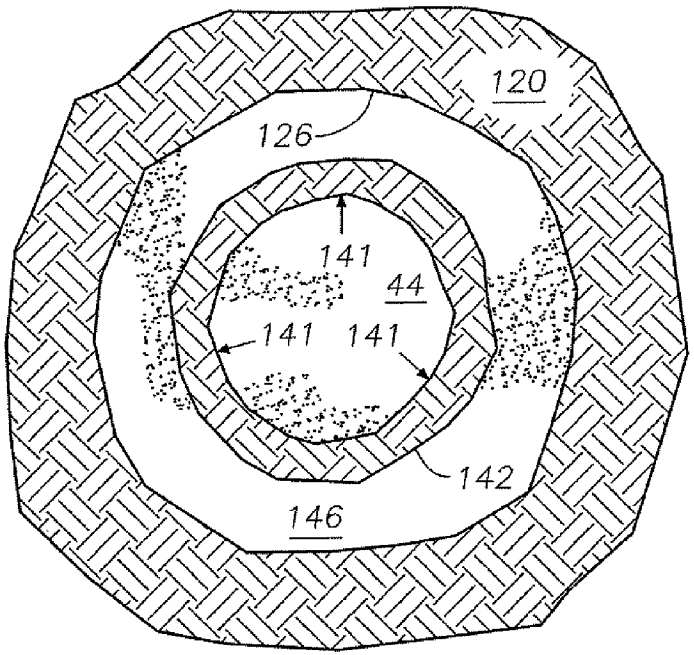
FIG. 6 is a top plan view of a bottom surface of a well bore formed by the first embodiment of a drill bit of FIG. 5 according to the present invention.

FIG. 6 illustrates a rock ring 124 formed by the drill bit 110. An excavated interior cavity 144 is worn away by an interior portion of the drill bit 110 and the exterior cavity 146 and inner wall 126 of the well bore 120 are worn away by an exterior portion of the drill bit 110. The rock ring 142 possesses hoop strength, which holds the rock ring 142 together and resists breakage The hoop strength of the rock ring 142 is typically much less than the strength of the bottom surface 122 or the inner wall 126 of the well bore 120, thereby making the drilling of the bottom surface 122 less demanding on the drill bit 110. By applying a compressive load and aside load, shown with arrows 141, on the rock ring 142, the drill bit 110 causes the rock ring 142 to fracture. The drilling fluid 140 then washes the residual pieces of the rock ring 142 back up to the surface through the well bore annulus 124.

The mechanical cutters, utilized on many of the surfaces of the drill bit 110, may be any type of protrusion or surface used to abrade the rock formation by contact of the mechanical cutters with the rock formation. The mechanical cutters may be Polycrystalline Diamond Coated (PDC), or any other suitable type mechanical cutter such as tungsten carbide cutters. The mechanical cutters may be formed in a variety of shapes, for example, hemispherically shaped, cone shaped, etc. Several sizes of mechanical cutters are also available, depending on the size of drill bit used and the hardness of the rock formation being cut.

Figure 7:
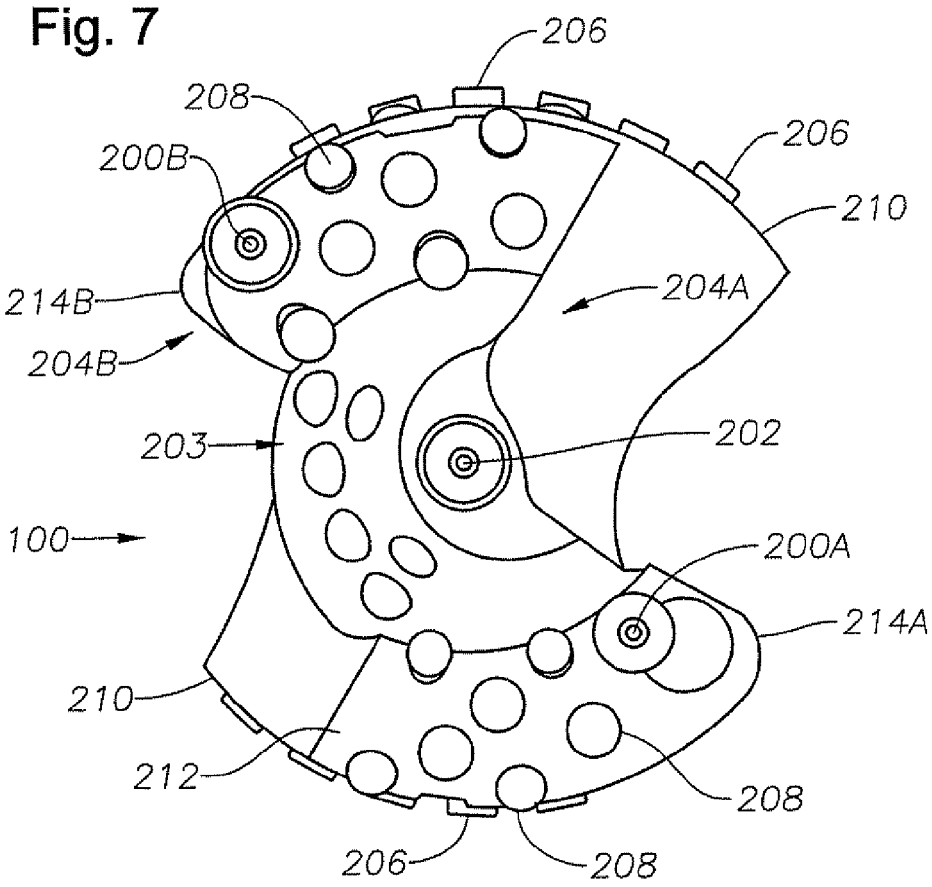
FIG. 7 is an end elevational view of the first embodiment of a drill bit of FIG. 5 according to the present invention.

FIG. 7 illustrates drill bit 110 of FIG. 5 and includes two side nozzles 200A, 200B and a center nozzle 202. The side and center nozzles 200A, 200B, 202 discharge drilling fluid and solid material impactors (not shown) into the rock formation or other surface being excavated. The solid material impactors may include steel shot ranging in diameter from about 0.010 inches to about 0.500 inches. However, various diameters and materials such as ceramics, etc. may be utilized in combination with the drill bit 120. The solid material impactors contact the bottom surface 122 of the well bore 120 and are circulated through the annulus 124 to the surface. The solid material impactors may also make up any suitable percentage of the drilling fluid for drilling through a particular formation.

The center nozzle 202 (see FIGS. 7 and 15) is located in a center portion 203 of the drill bit 110. The center nozzle 202 may be angled to the longitudinal axis of the drill bit 110 to create an excavated interior cavity 244 and also cause the rebounding solid material impactors to flow into the major junk slot, or passage, 204A. The side nozzle 200A located on a side arm 214A of the drill bit 110 may also be oriented to allow the solid material impactors to contact the bottom surface 122 of the well bore 120 and then rebound into the major junk slot, or passage, 204A. The second side nozzle 200B is located on a second side arm 214B. The second side nozzle 200B may be oriented to allow the solid material impactors to contact the bottom surface 122 of the well bore 120 and then rebound into a minor junk slot, or passage, 204B. The orientation of the side nozzles 200A, 200B may be used to facilitate the drilling of the large exterior cavity 46. The side nozzles 200A, 200B may be oriented to cut different portions of the bottom surface 122. For example, the side nozzle 200B may be angled to cut the outer portion of the excavated exterior cavity 146 and the side nozzle 200A may be angled to cut the inner portion of the excavated exterior cavity 146. The major and minor junk slots, or passages, 204A, 204B allow the solid material impactors, cuttings, and drilling fluid 240 to flow up through the well bore annulus 124 back to the surface. The major and minor junk slots, or passages, 204A, 204B are oriented to allow the solid material impactors and cuttings to freely flow from the bottom surface 122 to the annulus 124.

As described earlier, the drill bit 110 may also include mechanical cutters and gauge cutters. Various mechanical cutters are shown along the surface of the drill bit 110. Hemispherical PDC cutters are interspersed along the bottom face and the side walls of the drill bit 110. These hemispherical cutters along the bottom face break down the large portions of the rock ring 142 and also abrade the bottom surface 122 of the well bore 120. Another type of mechanical cutter along the side arms 214A, 214B is a gauge cutter 230. The gauge cutters 230 form the final diameter of the well bore 120. The gauge cutters 230 trim a small portion of the well bore 120 not removed by other means. Gauge bearing surfaces 206 are interspersed throughout the side walls of the drill bit 110. The gauge bearing surfaces 206 ride in the well bore 120 already trimmed by the gauge cutters 230. The gauge bearing surfaces 206 may also stabilize the drill bit 110 within the well bore 120 and aid in preventing vibration.

The center portion 203 (see, e.g., FIG. 7) includes a breaker surface, located near the center nozzle 202, includes mechanical cutters 208 for loading the rock ring 142. The mechanical cutters 208 abrade and deliver load to the lower stress rock ring 142. The mechanical cutters 208 may include PDC cutters, or any other suitable mechanical cutters. The breaker surface is a conical surface that creates the compressive and side loads for fracturing the rock ring 142. The breaker surface and the mechanical cutters 208 apply force against the inner boundary of the rock ring 142 and fracture the rock ring 142. Once fractured, the pieces of the rock ring 142 are circulated to the surface through the major and minor junk slots, or passages, 204A, 204B.

Figure 8:
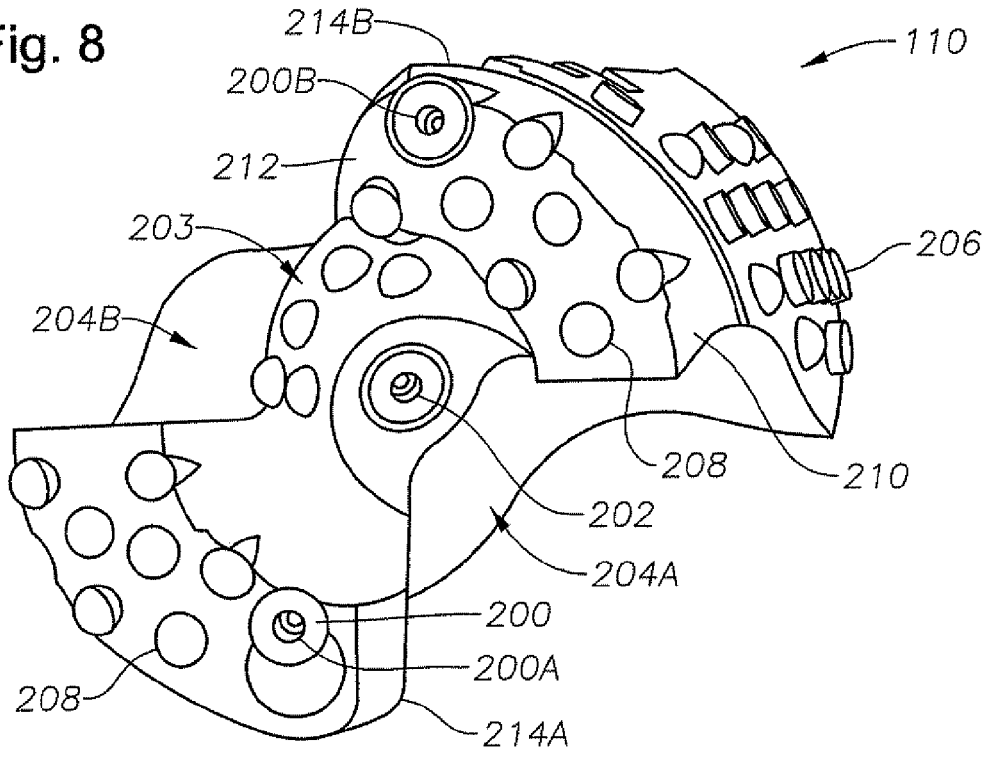
FIG. 8 is an end perspective view of the first embodiment of a drill bit of FIG. 5 according to the present invention.

FIG. 8 illustrates a drill bit 110 having the gauge bearing surfaces 206 and mechanical cutters 208 being interspersed on the outer side walls of the drill bit 110. The mechanical cutters 208 along the side walls may also aid in the process of creating drill bit 110 stability and also may perform the function of the gauge bearing surfaces 206 if they fail. The mechanical cutters 208 are oriented in various directions to reduce the wear of the gauge bearing surface 206 and also maintain the correct well bore 120 diameter. As noted with the mechanical cutters 208 of the breaker surface, the solid material impactors fracture the bottom surface 122 of the well bore 120 and, as such, the mechanical cutters 208 remove remaining ridges of rock and assist in the cutting of the bottom hole. However, the drill bit 110 need not necessarily have the mechanical cutters 208 on the side wall of the drill bit 110.

Figure 9:
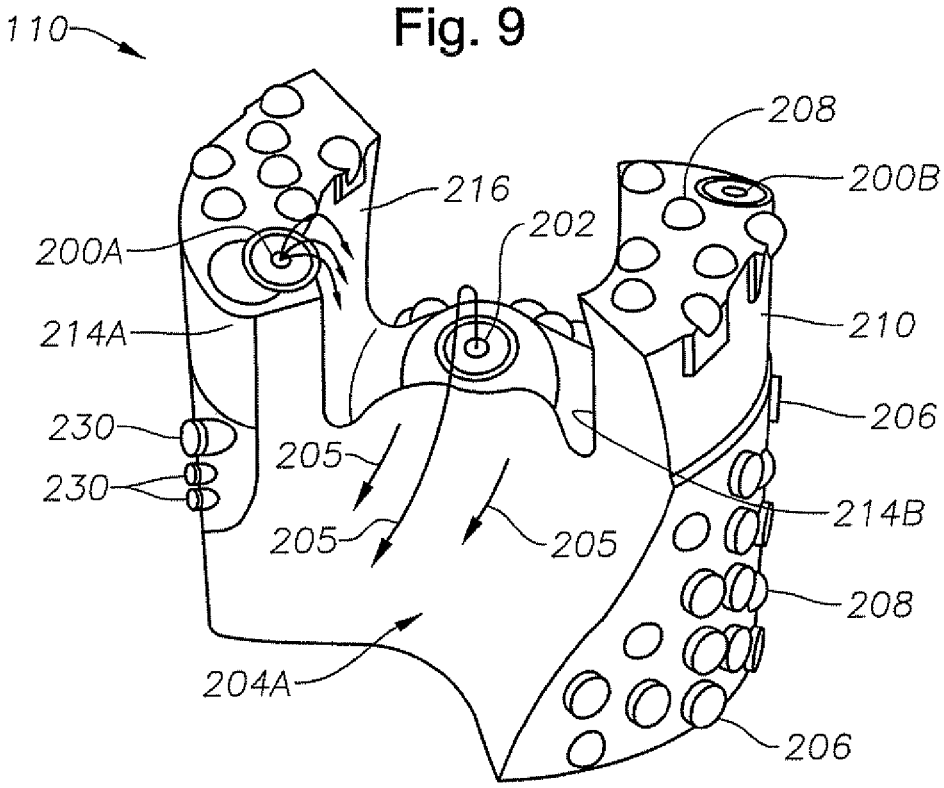
FIG. 9 is a side perspective view of the first embodiment of a drill bit of FIG. 5 according to the present invention.

FIG. 9 illustrates the drill bit 110 having the gauge cutters 230 included along the side arms 214A, 214B of the drill bit 110. The gauge cutters 230 are oriented so that a cutting face of the gauge cutter 230 contacts the inner wall 126 of the well bore 120. The gauge cutters 230 may contact the inner wall 126 of the well bore at any suitable backrake, for example, a backrake of about 15° to about 45°. Typically, the outer edge of the cutting face scrapes along the inner wall 126 to refine the diameter of the well bore 120.

One side nozzle 200A (FIG. 9) is disposed on an interior portion of the side arm 214A and the second side nozzle 200B is disposed on an exterior portion of the opposite side arm 214B. Although the side nozzles 200A, 200B are shown located on separate side arms 214A, 214B of the drill bit 110, the side nozzles 200A, 200B may also be disposed on the same side arm 214A or 214B. Also, there may only be one side nozzle, 200A or 200B. Also, there may only be one side arm, 214A or 214B.

Each side arm 214A, 214E fits in the excavated exterior cavity 146 formed by the side nozzles 200A, 200B and the mechanical cutters 208 on the face 212 of each side arm 214A, 214B. The solid material impactors from one side nozzle 200A rebound from the rock formation and combine with the drilling fluid and cuttings flow to the major junk slot 204A and up to the annulus 124. The flow of the solid material impactors, shown by arrows 205, from the center nozzle 202 also rebound from the rock formation up through the major junk slot 204A.

Figure 10:
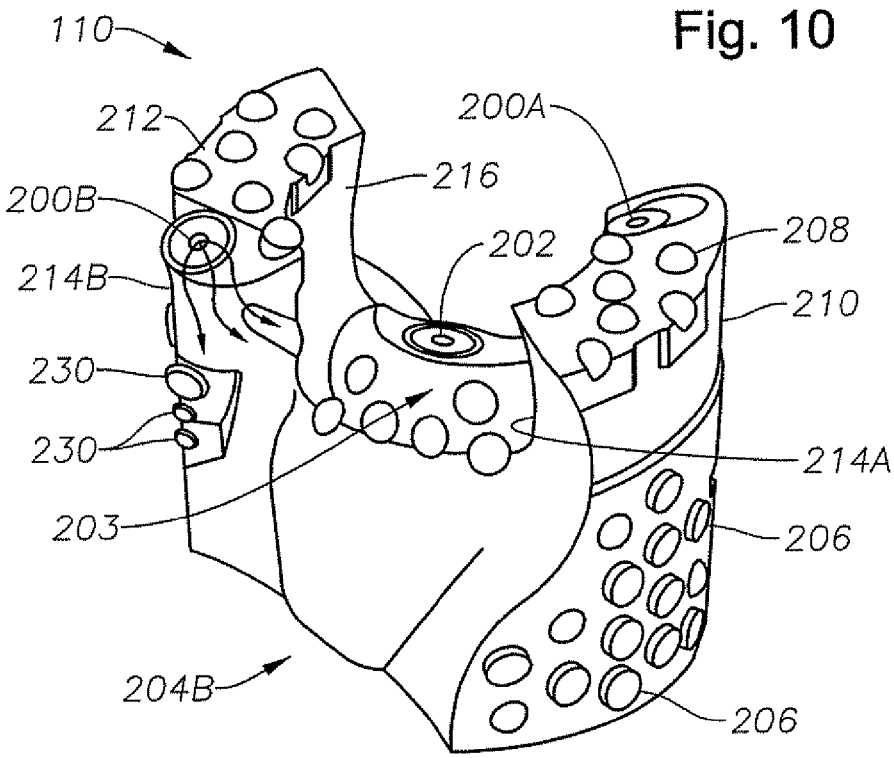
FIG. 10 is another side perspective view of the first embodiment of a drill bit of FIG. 5 illustrating a breaker and junk slot of a drill bit according to embodiments of the present invention.
Figure 11:
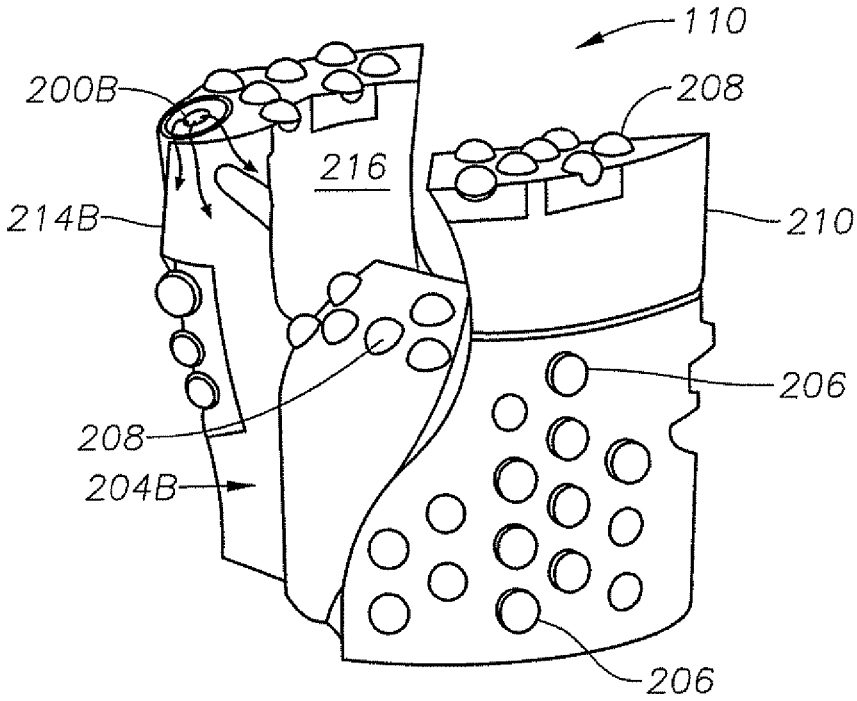
FIG. 11 is another side perspective view of the first embodiment of a drill bit of FIG. 5 illustrating a flow of solid material impactors according to embodiments of the present invention.

Minor junk slot 204B, breaker surface, and the second side nozzle 200B are shown in greater detail in FIGS. 10 and 11. The breaker surface is conically shaped, tapering to the center nozzle 202. The second side nozzle 200B is oriented at an angle to allow the outer portion of the excavated exterior cavity 146 to be contacted with solid material impactors. The solid material impactors then rebound up through the minor junk slot 204B, shown by arrows 205, along with any cuttings and drilling fluid 240 associated therewith.

Figure 12:
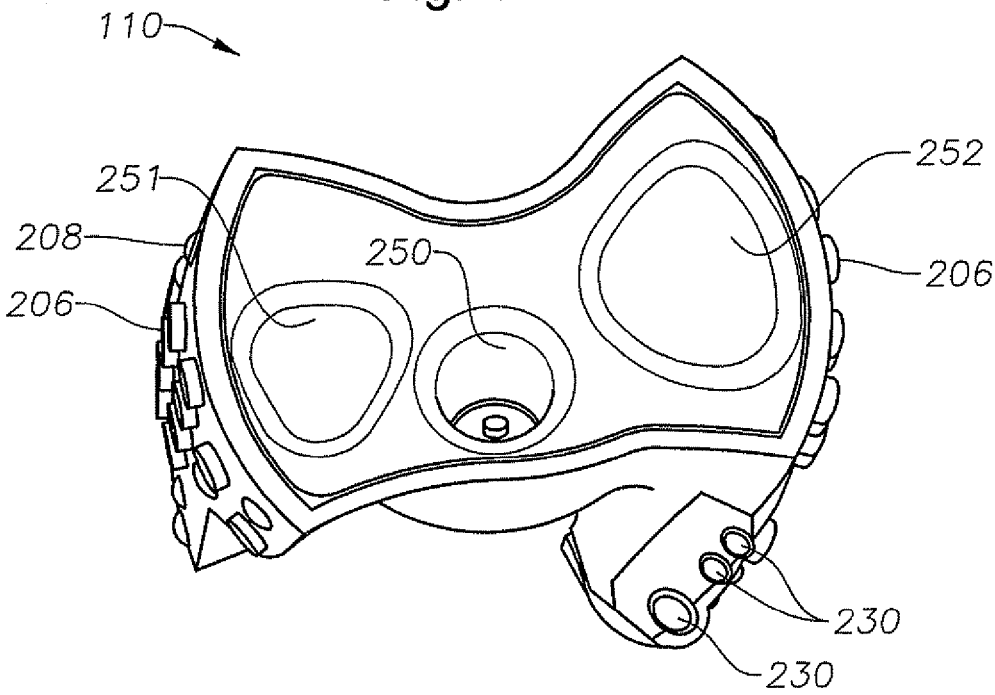
FIG. 12 is a top perspective view of the first embodiment of a drill bit of FIG. 5 illustrating side and center cavities according to embodiments of the present invention.

FIGS. 12 and 13 illustrate a drill bit 110 having each nozzle 200A, 200B, 202 positioned to receive drilling fluid 240 and solid material impactors from a common plenum feeding separate cavities 250, 251, and 252. Because the common plenum has a diameter, or cross section, greater than the diameter of each cavity 250, 251, and 252, the mixture, or suspension of drilling fluid and impactors is accelerated as it passes from the plenum to each cavity. The center cavity 250 feeds a suspension of drilling fluid 240 and solid material impactors to the center nozzle 202 for contact with the rock formation. The side cavities 251, 252 are formed in the interior of the side arms 214A, 214B of the drill bit 110, respectively. The side cavities 251, 252 provide drilling fluid 240 and solid material impactors to the side nozzles 200A, 200B for contact with the rock formation. By utilizing separate cavities 250, 251,252 for each nozzle 202, 200A, 200B, the percentages of solid material impactors in the drilling fluid 240 and the hydraulic pressure delivered through the nozzles 200A, 200B, 202 can be specifically tailored for each nozzle 200A, 200B, 202. Solid material impactor distribution can also be adjusted by changing the nozzle diameters of the side and center nozzles 200A, 200B, and 202 by changing the diameters of the nozzles. In alternate embodiments, however, other arrangements of the cavities 250, 251, 252, or the utilization of a single cavity, are possible.

FIG. 14 illustrates the drill bit 110 in engagement with the rock formation 270. As previously discussed, the solid material impactors 272 flow from the nozzles 200A, 200B, 202 and make contact with the rock formation 270 to create the rock ring 142 between the side arms 214A, 214B of the drill bit 110 and the center nozzle 202 of the drill bit 110. The solid material impactors 272 from the center nozzle 202 create the excavated interior cavity 244 while the side nozzles 200A, 200B create the excavated exterior cavity 146 to form the outer boundary of the rock ring 142. The gauge cutters 230 refine the more crude well bore 120 cut by the solid material impactors 272 into a well bore 120 with a smoother inner wall 126 of the correct diameter.

The solid material impactors 272 (FIG. 14) flow from the first side nozzle 200A between the outer surface of the rock ring 142 and the interior wall 216 in order to move up through the major junk slot 204A to the surface. The second side nozzle 200B (not shown) emits solid material impactors 272 that rebound toward the outer surface of the rock ring 142 and to the minor junk slot 204B (not shown). The solid material impactors 272 from the side nozzles 200A, 200B may contact the outer surface of the rock ring 142 causing abrasion to further weaken the stability of the rock ring 142. Recesses 274 around the breaker surface of the drill bit 110 may provide a void to allow the broken portions of the rock ring 142 to flow from the bottom surface 122 of the well bore 120 to the major or minor junk slot 204A, 204B.

Figure 15:
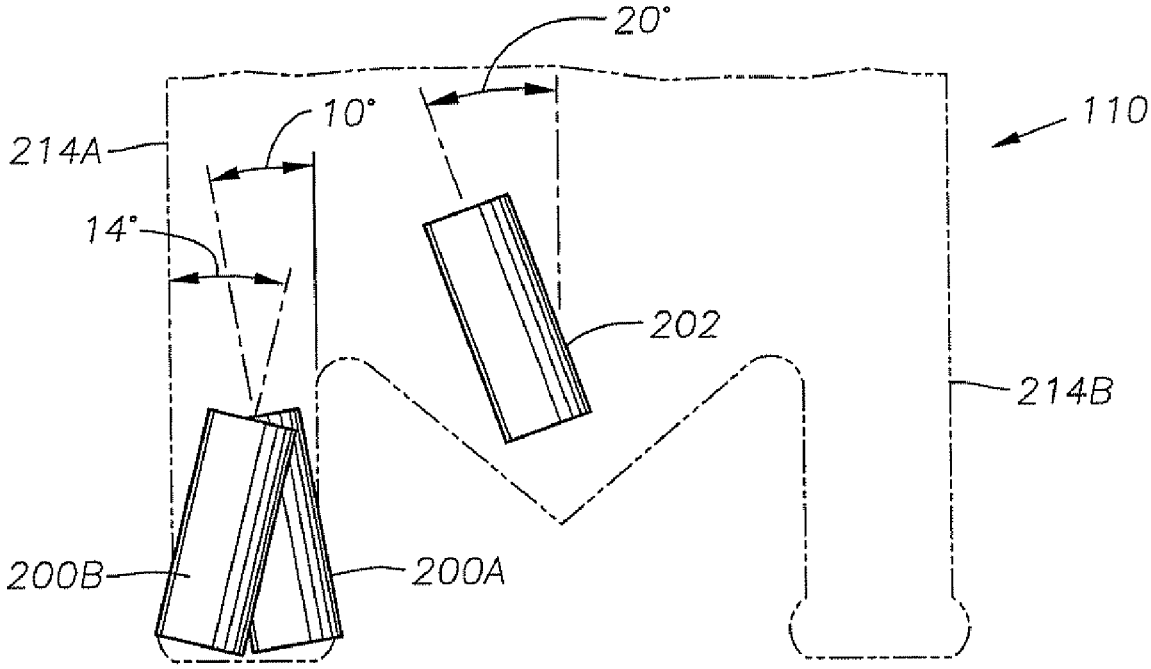
FIG. 15 is a schematic diagram of an orientation of a plurality of nozzles of a second embodiment of a drill bit according to the present invention.

FIG. 15 illustrates an example orientation of the nozzles 200A, 2000 202. The center nozzle 202 is disposed left of the center line of the drill bit 110 and angled on the order of around 20° left of vertical. Alternatively, both of the side nozzles 200A, 200B may be disposed on the same side arm 214 of the drill bit 110 as shown in FIG. 15. In this embodiment, the first side nozzle 200A, oriented to cut the inner portion of the excavated exterior cavity 146, is angled on the order of around 10° left of vertical. The second side nozzle 200B is oriented at an angle on the order of around 14° right of vertical. This particular orientation of the nozzles allows for a large interior excavated cavity 244 to be created by the center nozzle 202. The side nozzles 200A, 200B create a large enough excavated exterior cavity 146 in order to allow the side arms 214A, 214B to fit in the excavated exterior cavity 146 without incurring a substantial amount of resistance from uncut portions of the rock formation 270. By varying the orientation of the center nozzle 202, the excavated interior cavity 244 may be substantially larger or smaller than the excavated interior cavity 244 illustrated in FIG. 14. The side nozzles 200A, 200B may be varied in orientation in order to create a larger excavated exterior cavity 146, thereby decreasing the size of the rock ring 142 and increasing the amount of mechanical cutting required to drill through the bottom surface 122 of the well bore 120. Alternatively, the side nozzles 200A, 200B may be oriented to decrease the amount of the inner wall 126 contacted by the solid material impactors 272. By orienting the side nozzles 200A, 200B at, for example, a vertical orientation, only a center portion of the excavated exterior cavity 146 would be cut by the solid material impactors and the mechanical cutters would then be required to cut a large portion of the inner wall 126 of the well bore 120.

Figure 16:
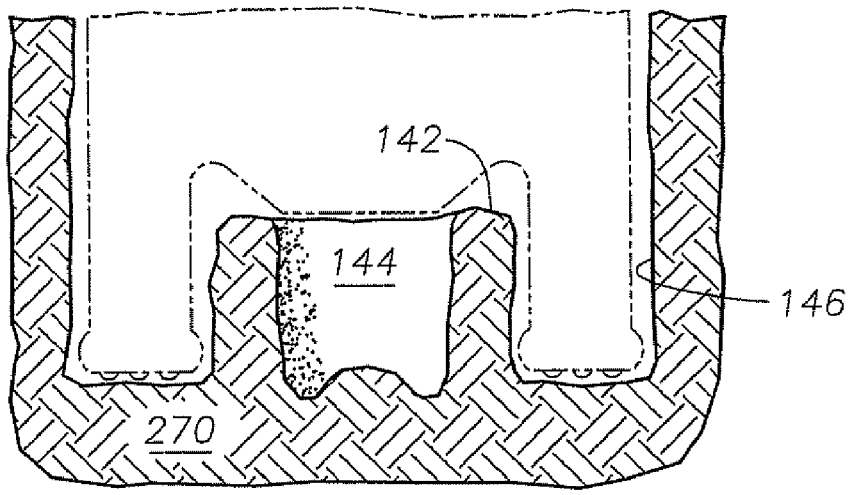
FIG. 16 is a sectional view of a rock formation created by the first embodiment of the drill bit of FIG. 5 represented by the drill bit inserted therein being in broken lines according to the present invention.
Figure 17:
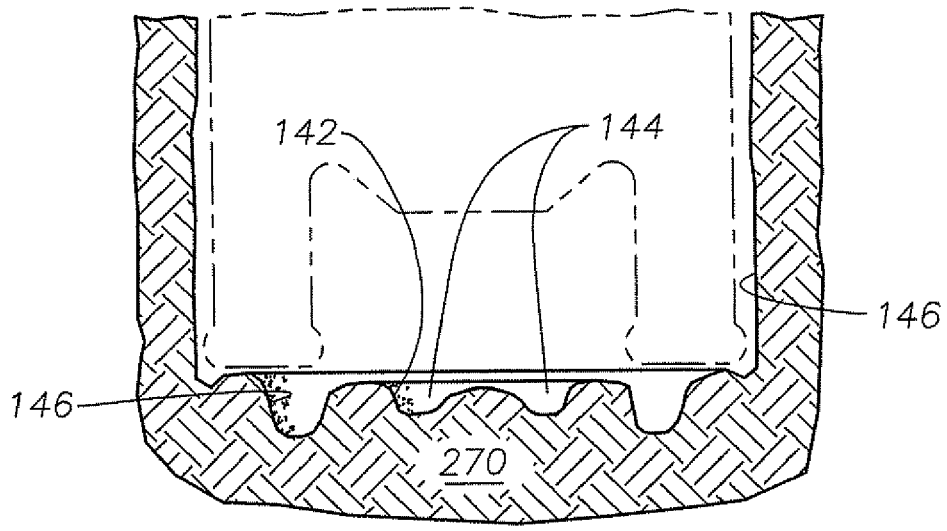
FIG. 17 is a sectional view of a rock formation created by the first embodiment of the drill bit of FIG. 5 represented by the drill bit inserted therein being in broken lines according to the present invention.

The bottom surface 122 of the well bore 120 drilled by the drill bit 110 are shown in FIGS. 16-17. With the center nozzle angled on the order of around 20° left of vertical and the side nozzles 200A, 200B angled on the order of around 10° left of vertical and around 14° right of vertical, respectively, the rock ring 142 is formed. By increasing the angle of the side nozzle 200A, 200B orientation, an alternate rock ring 142 shape and bottom surface 122 is cut as shown in FIG. 17. The excavated interior cavity 244 and rock ring 142 are much more shallow as compared with the rock ring 142 in FIG. 16. It is understood that various different bottom hole patterns can be generated by different nozzle configurations.

Although the drill bit 110 is described comprising orientations of nozzles and mechanical cutters, any orientation of either nozzles, mechanical cutters, or both may be utilized. The drill bit 110 need not have a center portion 203. The drill bit 110 also need not even create the rock ring 142. For example, the drill bit may only have a single nozzle and a single junk slot. Furthermore, although the description of the drill bit 110 describes types and orientations of mechanical cutters, the mechanical cutters may be formed of a variety of substances, and formed in a variety of shapes.

Figure 18:
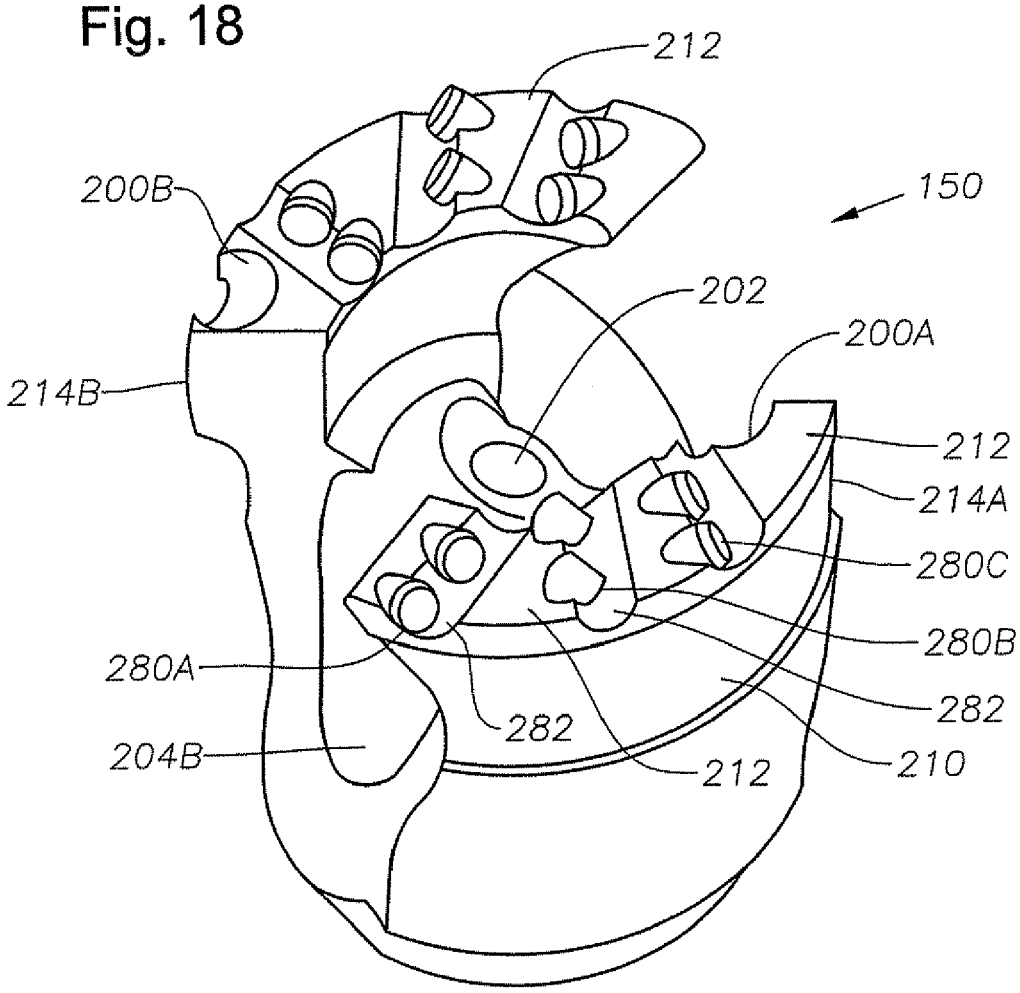
FIG. 18 is a perspective view of an alternative embodiment of a drill bit according to the present invention.
Figure 19:
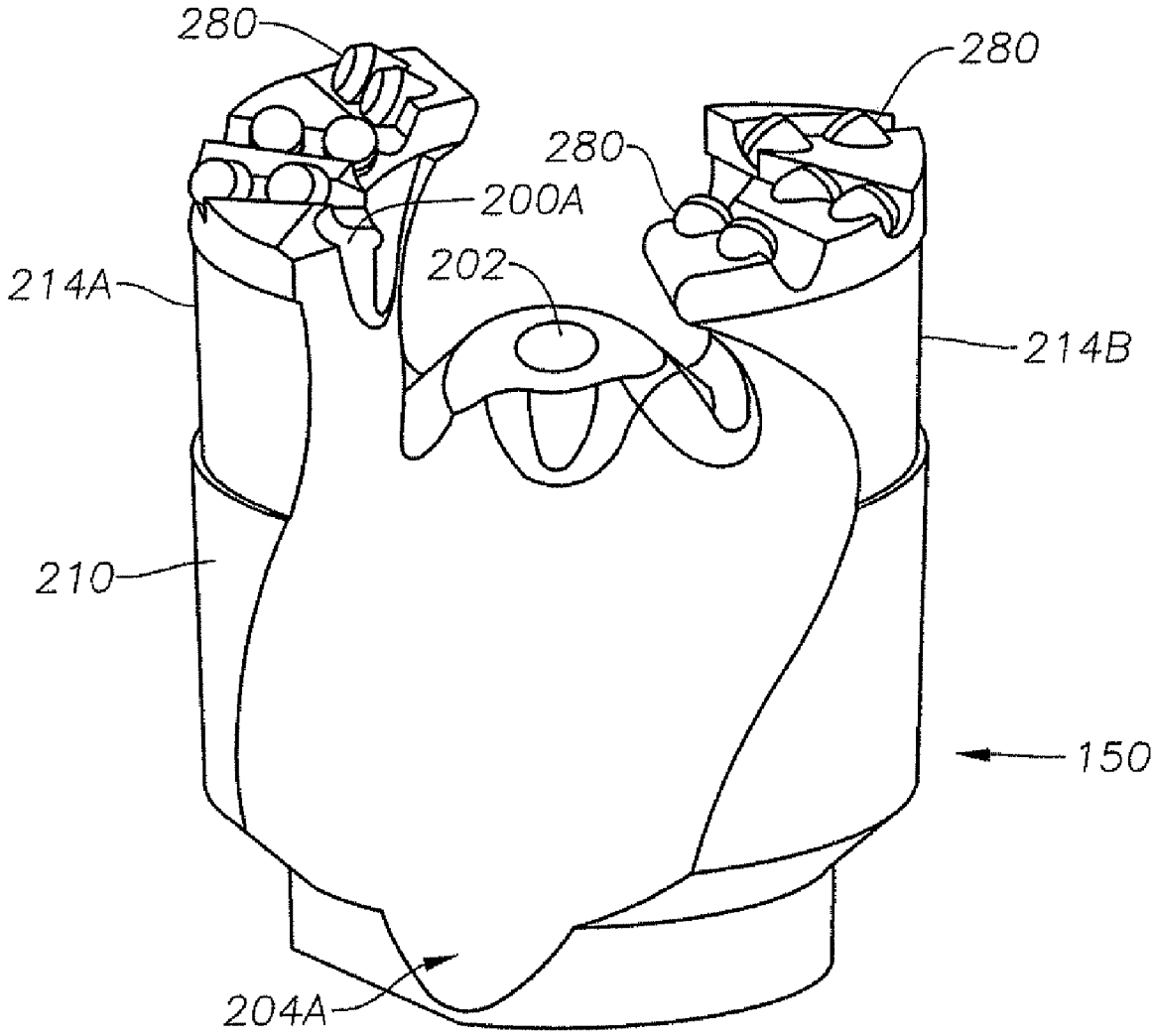
FIG. 19 is a perspective view of the alternative embodiment of a drill bit of FIG. 18 according to the present invention.

FIGS. 18-19 illustrate a drill bit 150 in accordance with a second embodiment of the present invention. As previously noted, the mechanical cutters, such as the gauge cutters 230, mechanical cutters 208, and gauge bearing surfaces 206 may not be necessary in conjunction with the nozzles 200A, 200B, 202 in order to drill the required well bore 120. The side wall of the drill bit 150 may or may not be interspersed with mechanical cutters. The side nozzles 200A, 200B and the center nozzle 202 are oriented in the same manner as in the drill bit 150, however, the face 212 of the side arms 214A, 214B includes angled (PDCs) 280 as the mechanical cutters.

In FIGS. 18-20, for example, each row of PDCs 280 is angled to cut a specific area of the bottom surface 122 of the well bore 120. A first row of PDCs 280A is oriented to cut the bottom surface 122 and also cut the inner wall 126 of the well bore 120 to the proper diameter. A groove 282 is disposed between the cutting faces of the PDCs 280 and the face 212 of the drill bit 150. The grooves 282 receive cuttings, drilling fluid 240, and solid material impactors and direct them toward the center nozzle 202 to flow through the major and minor junk slots, or passages, 204A, 204B toward the surface. The grooves 282 may also direct some cuttings, drilling fluid 240, and solid material impactors toward the inner wall 126 to be received by the annulus 124 and also flow to the surface. Each subsequent row of PDCs 280B, 280C may be oriented in the same or different position than the first row of PDCs 280A. For example, the subsequent rows of PDCs 280B, 280C may be oriented to cut the exterior face of the rock ring 142 as opposed to the inner wall 126 of the well bore 120. The grooves 282 on one side arm 214A may also be oriented to direct the cuttings and drilling fluid 240 toward the center nozzle 202 and to the annulus 124 via the major junk slot 204A. The second side arm 21413 may have grooves 282 oriented to direct the cuttings and drilling fluid 240 to the inner wall 126 of the well bore 120 and to the annulus 124 via the minor junk slot 204B.

The PDCs 280 located on the face 212 of each side arm 214A, 214B are sufficient to cut the inner wall 126 to the correct size. Mechanical cutters, however, may be placed throughout the side wall of the drill bit 150 to further enhance the stabilization and cutting ability of the drill bit 150.

Additional downhole applications are provided below; they include Downhole Milling, Under Reaming, Removing Near Borehole Damage, Assisted Annular Flow, Coring, and Perforating. Each of these applications include directing impactors in a circulation fluid, as described above, for downhole excavating purposes. The fluid may comprise wellbore fluid, drilling fluid, foam, a substance acting as a fluid, a substance having a fluid phase, a substance acting as an impactor carrier, and any medium for conveying impactors. The impactors may be fully or partially recovered for later use, or may be fully or partially abandoned in the wellbore or elsewhere. The impactor speed may range from around 100 feet/second to around 1000 feet/second and all ranges of values therebetween. Other impactor speeds include around 350 feet/second, 400, feet/second, 450 feet/second, 500 feet/second, 550 feet/second and above. The speed may either be at nozzle exit or upon collision of the impactor with what is being excavated.

Downhole Milling

Casing and window milling are performed for a variety of purposes. The basic concept for milling a window is to create an opening in a cased hole which connects the bore hole with a downhole formation. Some of the purposes are, but not limited, to create an opening in casing which allows directional drilling away from the borehole and casing, to create an opening in casing to provide means to horizontally drill boreholes away from the cased borehole, to create an opening through casing to allow drilling around debris that cannot be or economically retrieved in a borehole, and create openings that allow formation information to be gathered by a variety of tools and probes.

Traditionally these openings are created by forcing a drill head to be rotated by a drill string, downhole motor, or downhole turbine. Tools are set in the casing at the location where the window (opening) in the casing will be created. One of the most common types of tools used is referred to a whipstock. The tool consists of anchors to make it immobile in the casing and a concaved tapered section which starts at a full diameter of the internal casing diameter and tapers across the whole diameter of the interior of the casing. A cutting head is both rotated and advanced against the whipstock. As the cutting head is advanced, the taper forces the cutting structure of the cutting head against the interior wall of the casing. As the cutting head continues to advance downhole, it progressively cuts the casing and eventually cuts completely through the casing or multiple casings essentially concentric to each other, and enters the formation drilling an angled hole the diameter of the cutting head.

The cutting heads usually include conventional drill bits, or specially fabricated cutting heads having tungsten carbide shards or pieces attached to a thread bearing body. Conventional bits such as rolling cone bits, natural diamond bits, synthetic diamond bits, and impregnated diamond bits can be used to create these openings in the casing. A window can also be created using a downhole motor and bent subs. A downhole motor is attached to a bent sub in the lower portion of the drill string. The bent sub assembly is positioned in the direction that the casing opening will be formed. The drill string is not rotated but the downhole motor or turbine rotates the cutting head or bit. Using whipstock types of tools or plugs, the assembly is advanced by adding weight to the cutting assembly via the drill string. The downhole motor and bit combination will eventually cut through the casing and into the formation in the direction and angle from vertical as planned.

Horizontal drilling is accomplished in much the same way. The main difference is in the size and departure angle from the cased borehole to create a short radius turn into the formation. Once the short radius borehole is cut through the casing and reaches near horizontal, the borehole is drilled horizontally to engage more producing surface area in the producing formation. The issue in opening these casing windows is the time it takes to cut through the steel casing. Conventional bits and cutting heads will have only a small portion of their cutting structures engaged in cutting the casing from the start and through a significant part of cutting the window. Because of the small number of cutters attacking the casing when cutting is being done early in the process, very light weights on bit are used as not to damage the cutting structure of the bit and rendering the bit damaged before the opening is completely cut. Not only is the cutting structure in danger of damage, but cutting steel compared to rock is much harder for conventional bits. Carbide bearing milling tools are somewhat better but still slow and cannot drill into the formation as far as needed after the milled window has been cut economically. Diamond does not do well in the presence of iron and degrades when temperatures are elevated at the cutting edge of the diamond.

As discussed above, PID technology has demonstrated it can excavate through hard formations at 3-5 times the rate of conventional drill bit systems. Laboratory tests indicate a PID system can penetrate metals and metal composites at higher rates as well. As described above and in the referenced patents and patent applications, the PID system includes an injections means that deposits a small volume percent of the total downhole fluid flow with particles (impactors). The impactors are transported to the bit or cutting head where the impactors are accelerated through nozzles to velocities sufficient to deliver the energy required to fail and erode an impacted surface. The conventional fluid flow rate for oil and gas excavating operations imparts several million impacts per minute onto the excavation surface. After impact the impactors migrate to the surface for recovery and reinjection into the pressurized circulating fluid stream downhole.

Figure 29:
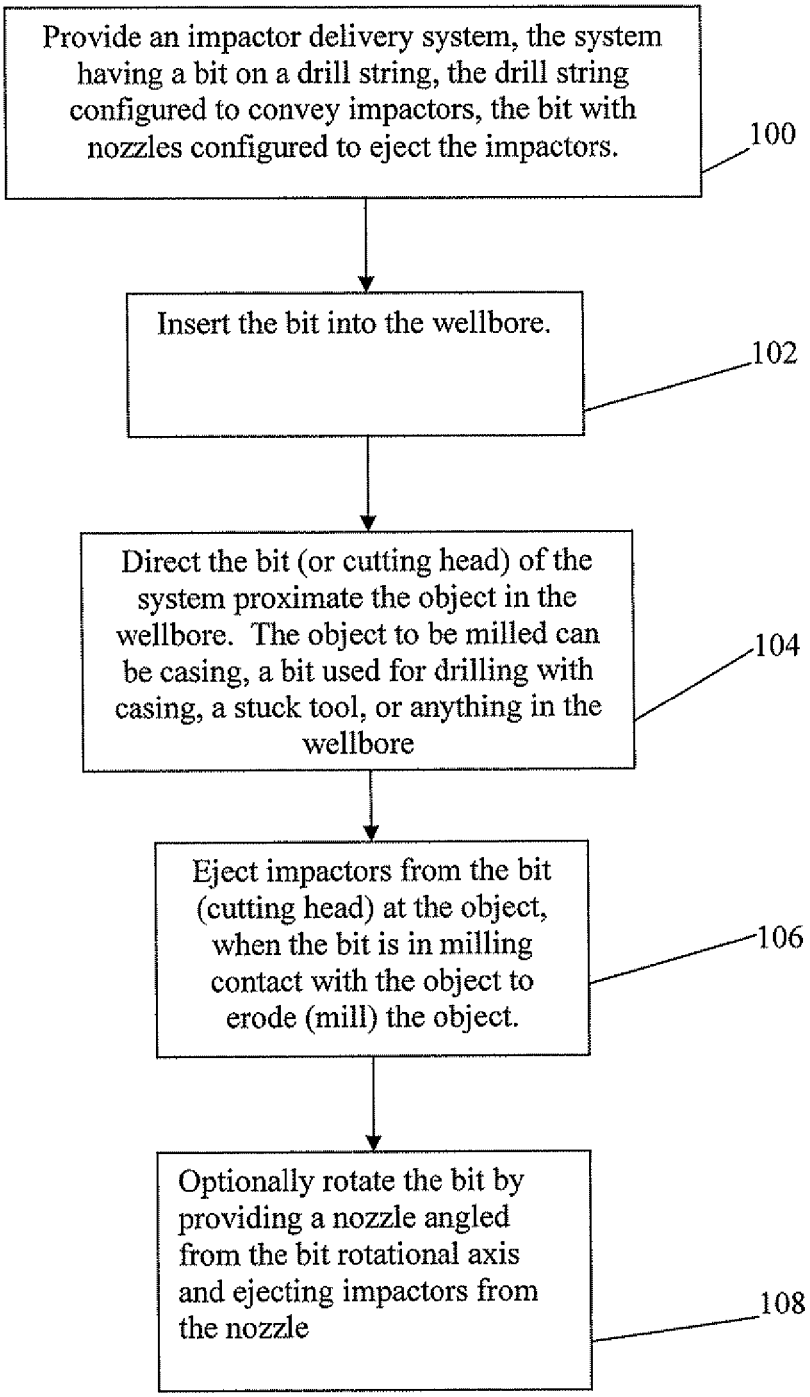
FIG. 29 illustrates a flow chart representing an embodiment of a method of use.

A particle impact drilling system can be used for milling an object in a wellbore. In an embodiment of this method, illustrated in flow chart of FIG. 29, includes providing a particle impact drilling system having a bit 2017 disposed on a drill string 2015 (step 100). The drill string 2015 as shown is configured to convey impactors in a circulating fluid under pressure to the bit 2017. A nozzle 2021 is positioned on the bit 2017 and is in fluid communication with the drill string 2015. The nozzle 2021 is configured to eject the impactors at a velocity so the impactors have sufficient energy they compress, fracture, and structurally alter material within the wellbore.

One method of use, involves inserting the bit 2017 into a wellbore 2003 (step 102) and directing the bit 2017 adjacent the object within the wellbore 2003 (step 104). A plurality of impactors is then ejected from the bit 2017 when the bit 2017 is in milling contact with the object (step 106). Then the bit 2017 is urged toward and, in some circumstances through the object, while the impactors are ejected at the object and collide with the object. As discussed above, the impactors' collisions fracture the object thereby eroding it. Continued contact with colliding impactors removes the object by reducing it to cuttings that are washed away by circulating fluid, or forms an opening through the object; this is referred to herein as impact milling of the object. The object being milled or eroded, for example, includes casing 2007 which lines the wellbore 2003, a downhole tool lodged in the wellbore 2003, or a drilling bit 2043 used in forming a wellbore 2041 from a drilling with casing excavation operation. For the purposes of discussion herein, milling contact occurs when the bit 2017 is sufficiently proximate an object such that impactors ejected from the bit 2017 impact the object with a velocity so the impactors possess sufficient energy to erode away portions of the object by contact, thereby milling the object. In some situations this includes cutting through the object (such as in window milling). Milling contact also includes physical contact between the bit 2017 and the object that may occur when milling the object with the bit 2017.

It should be pointed out that the bit 2017 described herein is not limited to traditional drilling bits that drill by contact, but also includes devices formed to emit the impactors for excavating as described herein. In one example the device comprises a cutting member disposed on the end of a tubular, where the tubular includes impactors in a pressurized fluid. The cutting member provides a base on which an ejector element, such as t nozzle, is mounted and also communicates the ejectors and fluid to the ejector. Examples of such cutting members include cutting heads, lead mills, and any bit or mill modified to eject impactors for eroding an object. Accordingly the bit 2017 of the present disclosure can excavate without physically contacting what is being excavated, i.e. formation or object. Additionally, the present disclosure includes eroding or milling in a wellbore using any system that directs impactors at an object (or formation) with sufficient velocity to fracture and thereby erode the object (or formation), whether or not the system includes a drilling capability. The term velocity as used herein includes its technical definition having components of speed and direction. Thus sufficient velocity means the speed and direction of the impactor upon collision with the object's surface forms a fracture in the object.

Figure 21:
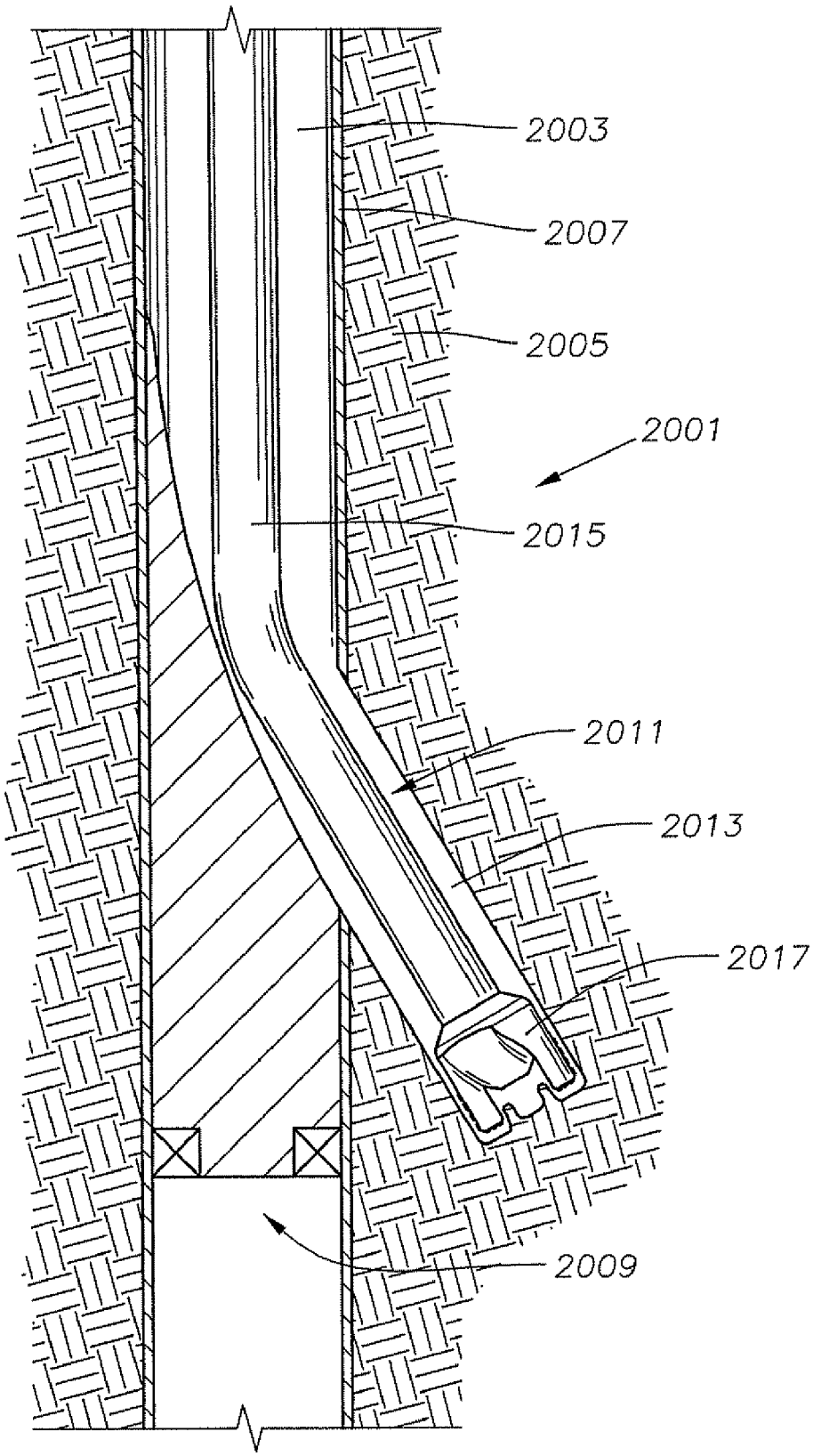
FIG. 21 is a side partial cut-away view of a particle drilling system window milling through wellbore casing according to an embodiment of the present invention.

An opening or window through casing can be created in numerous ways with particles. FIG. 21 provides an example of a particle impact drilling (PID) apparatus used for milling a casing window. In this embodiment, the PID apparatus 2001 is disposed in a wellbore 2003 lined with casing 2007. The PID apparatus includes a drilling string 2015 having a bit 2017 or cutting head on the end of the string 2015. A whipstock assembly 2009 is optionally anchored in the casing 2007 for angling the PID apparatus 2001 into cutting contact with the casing 2007. The bit 2017 may include specifically oriented nozzles to create a casing window 2011 or opening. As will be understood by those skilled in the art, the cutting head 2017 can be rotated on the drill string 2015 such that the placement and direction of the nozzle(s) can quickly remove all or parts of the casing target area. The nozzle(s) can be oriented in such a way that just an annular ring is cut in the casing and the remaining casing can drop into the borehole after being cut loose.

FIG. 22 illustrates an example of a bit 2017*a* rotatable about the bit rotational axis $A_R$ by forces developed from the angle of the nozzle 2022. The nozzle 2022 may be oriented to direct a discharge stream lateral to the bit 2017*a* or drill string, that is roughly perpendicular to the drill string and/or bit 2017*a* axes. The nozzle 2022 may or may not be aligned with the stream it produces. The nozzle 2022 may also be oriented oblique to the axes, i.e. some other than 90° to the string or bit 2017*a* axes. Optionally, a nozzle may be oriented on the drill string 2015 that does not have to be rotated from the surface to cut a window in the casing. A geometry pattern can be followed with at least a single nozzle to cut the periphery of a window in the casing without rotating a drill string from the surface. Nozzles can be aligned such that overlapping areas of impact can remove the window in the casing without drill string rotation (step 108).

Other downhole milling operations as well may be performed with a PID apparatus according to embodiments of the present invention. The PID apparatus is capable of removing materials from soft and elastic to ultra hard and tough, many parts, tools, and other debris not intended to be left in the hole can be drilled. Unlike conventional cutting structures, the PID apparatus may be used to cut ultra hard materials such as tungsten carbide and hardened steels, and ceramics as well as elastomeric materials. Examples of devices downhole that may be milled by a PID system include those lost in the hole (i.e. fish in the hole). The present disclosure also includes an alternative method of removing any object from a wellbore by milling the item, such objects or items include a downhole tool, a drill bit, a tubular member, and anything lodged in the wellbore. The system and method eroding (or milling) described herein can erode objects that cannot be drilled. These include objects that rotate within the wellbore, thus attempts to drill through the object would instead merely rotate it. Similarly, drilling elastomers can also be problematic since they may deform under an applied drilling load thereby deflecting the drill from the elastomer. Directing impactors at an object produces, among other things, fatigue loading in the surface that is being eroded. Either a rotatable object or an elastomer can be fatigued with applied impactors to thereby erode (or mill) either the rotatable object or elastomer.

Figure 23:
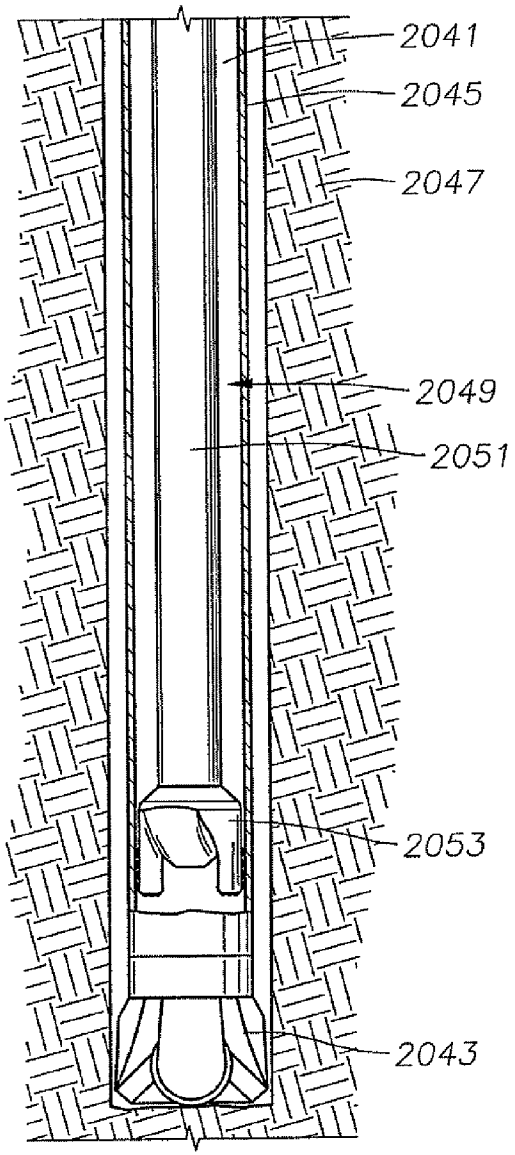
FIG. 23 is a side partial cut-away view of a particle drilling system milling material in a wellbore according to an embodiment of the present invention.

An example of another milling embodiment of an apparatus or system is provided in FIG. 23 where a PID apparatus 2049 is configured to mill a bit 2043 attached to casing 2045. In this example, the bit 2043 and casing 2045 is used to form a wellbore 2041. As shown, the PID system 2049 includes a drill string 2051 having a bit 2053 on its terminal end. Impact particles directed from the system 2049 erode the casing bit 2043 from the end of the casing after it has been drilled to depth. All of the components of conventional drill bits, including hardened steel, tungsten carbide, diamond, elastomers, and other materials can be removed at a fast rate by impacting the bits with particles at high velocity.

Under Reaming

Figure 24:
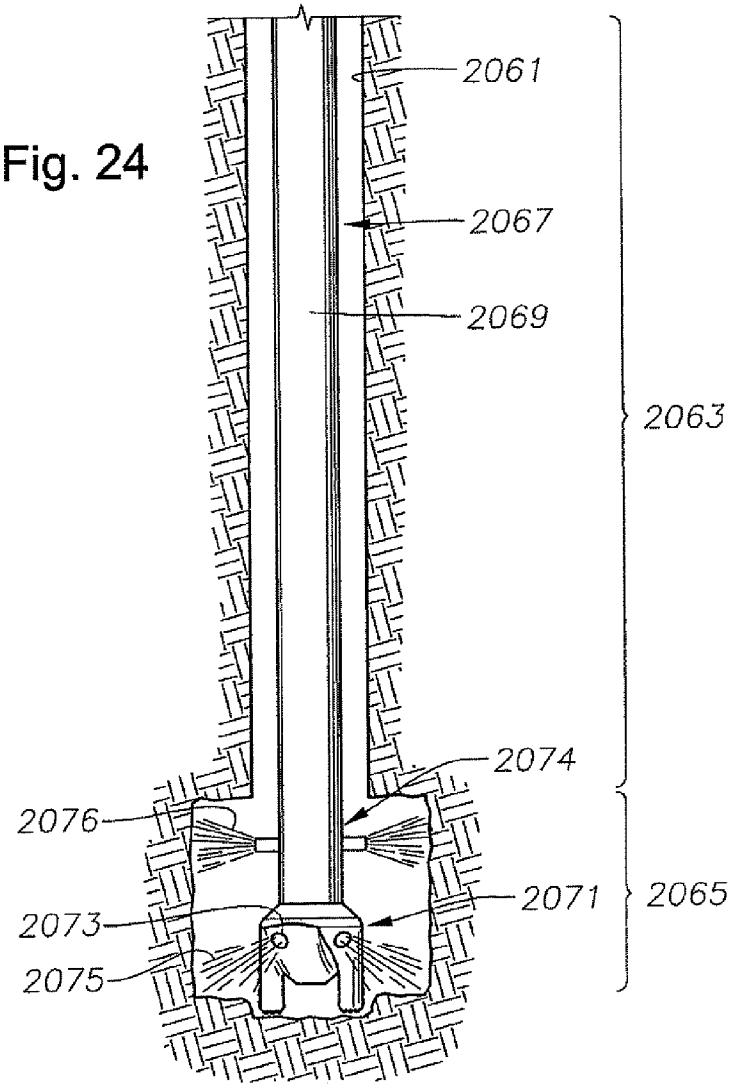
FIG. 24 depicts in side cut-away view an example of a particle drilling system use in under reaming a wellbore an embodiment of the present invention.

In many drilling applications it is advantageous to drill a larger diameter hole beneath an existing diameter borehole; a concept generally referred to as under reaming (see, e.g., FIG. 24). It is necessary that drilling tools, bits, and the like must have an overall diameter less than the existing borehole through which they must pass to continue drilling deeper. Examples requiring under reaming include forming a larger hole to provide a larger area for cementing casing, placing expandable casing below existing casing, over cutting the diameter of the hole to prevent mobile formations from swelling and trapping the drill pipe and other tools downhole. As understood by those skilled in the art, salt and some anhydrites are formations which have almost instantaneous strain rates followed by creep both of which can trap the drill string or significantly reduce drilling performance from parasitic losses from the formation contact.

Drilling tools used to "open" the hole larger generally are either eccentric, lobed, or have expanding parts as part of the drill bit or separate pieces that may be added to the drill string above the bit. In any case the bits and tools must be able to pass through the existing borehole prior to being activated or drill the larger hole. Eccentric bits and tools have not been totally reliable in increasing the hole size to the desired diameter for the interval to be opened up or leaving sections of the interval at a smaller than desired diameters both of which are not acceptable. Tools that are added to the drill string either directly above the bit or in the drill string somewhere above the bit can add bending stress to the tool joint when rotating and cutting. This can cause cyclic failure of the tool joint which can lead to washouts or tools being left in the hole. The performance of these tools can be diminished as well. The cutting of the extra hole is not obtained for free. Additional torque is required or the available torque must be shared both of which can reduce the performance by reducing the rate of penetration or add operational costs in developing more horsepower to drive the tools. Most conventional drilling bits and tools are dependent on high hydraulic horsepower to clean and cool the cutting structure(s). Usually the hydraulic horsepower must be also split downhole to feed both cutting tools and can significantly reduce the drilling performance.

As discussed above, PID technology has demonstrated it can excavate through hard formations at 3-5 times the rate of conventional drill bit systems. Laboratory tests indicate a PID system can penetrate metals and metal composites at higher rates as well. As described above and in the referenced patents and patent applications, the PID system includes an injections means that deposits a small volume percent of the total downhole fluid flow with particles (impactors). The impactors can be transported to the bit or cutting head and accelerated through nozzles to velocities sufficient to deliver the energy required to fail and erode the surface by impactor contact. The conventional fluid flow rate for oil and gas excavating operations imparts several million impacts per minute onto the excavation surface. After impact the impactors migrate to the surface for recovery and reinjection into the pressurized circulating fluid stream downhole.

PID technology can be used for under reaming by forming a device having a drill string 2069 configured to convey therefrom a plurality of impactors in a fluid under pressure. Because the mechanical energy required for under reaming is low, a PID bit may operate at 7000 to 15,000 pounds weight on bit, and because of no cutting structure on the bit, torque is low. The applied torque is only what is required to break the rock ring(s) in tension as the rings) is loaded against the angled rock breakers on the bit body. A bit 2071 may be included affixed to the drill string 2069 configured to receive the impactors in the fluid under pressure. The impactors may exit the bit 2071 through a nozzle 2073 configured to eject the impactors and fluid under pressure from the bit 2071 at high velocity so that the nozzle discharge is angled with respect to the wellbore axis for selectively increasing wellbore diameter.

Figure 30:
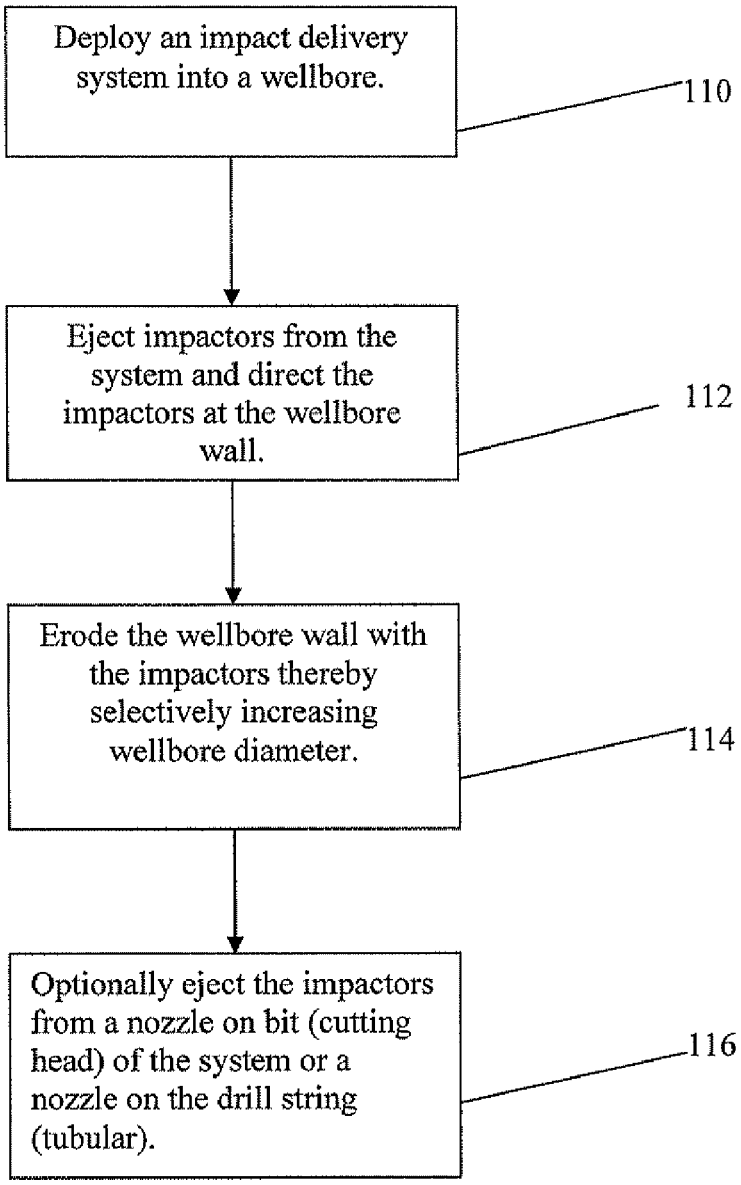
FIG. 30 illustrates a flow chart representing an embodiment of a method of use.

FIG. 24 illustrates an example of a PID system 2067 used for under reaming operations. In this embodiment, the PID system 2067 includes a drill string 2069 with an attached bit 2071 disposed in a wellbore 2061. FIG. 30 illustrates a flow chart outlining an example of a method of using the PID system 2067, the method includes deploying the system 2067 in a wellbore (step 110). The wellbore 2061 has an upper portion 2063 and lower portion 2065. The lower portion diameter exceeds the upper portion diameter as illustrated. The increased lower portion diameter is formed by selectively activating the under reaming options of the PID system 2067 at a desired depth within the borehole 2061 by ejecting impactors from the system that are directed at the wellbore wall (step 112).

Nozzles 2073 are shown disposed on the bit 2071 and angled downward. When in fluid communication with a mixture of impactors and pressurized circulating fluid, the nozzles 2073 can produce a spray pattern 2075 directed generally downward from the bit 2071. Nozzles 2074 are also provided on the system 2067 above the placement of the bit 2071. As shown, the upper nozzles 2074 are oriented generally perpendicular to the axis of the system 2067. Thus when in fluid communication with a mixture of impactors and pressurized circulating fluid the nozzles 2074 form a corresponding flow pattern 2076 lateral to the PID system 2067. Thus, selectively activating one or both of the nozzles (2073, 2074) can excavate within a wellbore thereby creating a borehole section having diameter greater than a section at a lower depth. Optionally the nozzles (2073, 2074) can be positioned at various angles ranging from parallel to perpendicular to the PID system 2067. For example, one or more nozzles may be directed off of the bit face and angled towards being perpendicular to the axis of the borehole. Nozzles may be optionally located on the drill string (step 116). In this orientation the particles leaving the nozzle will impact the formation at near perpendicularity and cut the additional hole more efficiently.

As will be understood by those skilled in the art, additional nozzles can be located at any location on the bit body. The orientation can be directed uphole as well as downhole. The uphole orientation will again cut any formation that has moved inwardly after the bit has passed. It would allow an "up drill" feature to aid in drilling out of the hole if a formation has sloughed in behind the bit and would create restrictions when the bit is tripped out of the hole. Additional tools can be added to the drill string which contain nozzles and can under ream above the bit as well. The PID technology can easily under ream boreholes faster than conventional methods with little applied mechanical energy. The PID low weight on bit, the drill string buckling and deviation problems associated with conventional under reaming with high weights on bit are avoided. PID technology enables directing the tool as desired without additional stabilizing tools.

Removing Near Borehole Damage

Most Oil and Gas wells are drilled using drilling mud, which has a variety of base fluids including water, oil, foam, and brines. The different types of muds are used in applications where their attributes are specific to the well conditions. Although there are many mud types, they all perform some basic functions. The muds carry entrained weighting materials, clays, and chemicals going into the borehole and they get additional cuttings, from the drilling process, which are added to drilling fluid as it moves from the bottom of the borehole to the surface.

The clays and weighting materials added to the mud are usually very fine in size. Many of the cuttings generated from conventional bits also are very fine in size as they are ground and reground during the drilling process. The weighting material is added to the fluid to increase the pressure the drilling fluid exerts on the borehole walls to maintain a greater pressure than that of the formation. This higher pressure keeps the pressurized oil and gas from escaping to the borehole and is called overbalanced drilling.

The formations that produce oil and gas contain pores in their fabric, as well as, channels that connect the pores, giving the formation permeability (the ability to transport hydrocarbons through the formation) when the well is eventually produced. Because the wellbore pressure is higher than the formation pore pressure, drilling mud is forced into the connected pores. The fluid phase of the drilling fluid is transported into the borehole walls and leaves the fine particles of clay, weighting material, and cuttings on and into the near surface of the producing borehole formation. This residual agglomeration of particles is called filter cake or mud cake and is particularly an issue, as permeability is reduced, when producing from an open hole or perforations.

Because the permeability of the filter cake can be very low, it aids in "sealing off the formation from additional fluid loss (spurt loss) to the formation. The sealing of the formation to additional fluid is advantageous, but the sealing process usually involves some of the very fine particles entering the formation pore spaces and traveling through the pores and connecting channels until the channel opening becomes too small to accept the particles. The particles, still being forced by the pressure differential between the borehole and the formation pressure, jam up the throats of the channels. As the largest particles are wedged into the pore throats, the openings between the pore opening and the particle are reduced in diameter, which intern can then be blocked by smaller particles. Basically the permeability of the formation is drastically reduced and in some cases becomes negligible.

When the well is completed, the filter cake may be removed by a variety of methods, as understood by those skilled in the art, but, the internal reduction of permeability in the near borehole is not easily removed as it was jammed into the pore throats under dynamic fluid pressure. When the hydrocarbons are introduced into the borehole by lowering the borehole pressure, some of the internal pore throat bridges are removed while many are not. The net effect can be a significant reduction of formation permeability due to a relatively thin zone at the borehole wall. This zone acts as a filter that limits the amount of production passing through it. Because the damaged zone is relatively thin, and near the surface, some wells are subjected to an acid treatment in an attempt to dissolve these bridges and increase production.

As discussed above, PID technology has demonstrated it can excavate through hard formations at a rate 3-5 times that of a conventional drill bit systems. Laboratory tests indicate a PID system can penetrate metals and metal composites at higher rates as well. As described above and in the referenced patents and patent applications, the PID system includes an injections means that deposits a small volume percent of the total downhole fluid flow with particles (impactors). The impactors are transported to the bit or cutting head where the impactors are accelerated through nozzles to velocities sufficient to deliver the energy required to fail and erode an impacted surface. The conventional fluid flow rate for oil and gas excavating operations imparts several million impacts per minute onto the excavation surface. After impact the impactors migrate to the surface for recovery and reinjection into the pressurized circulating fluid stream downhole.

Figure 31:
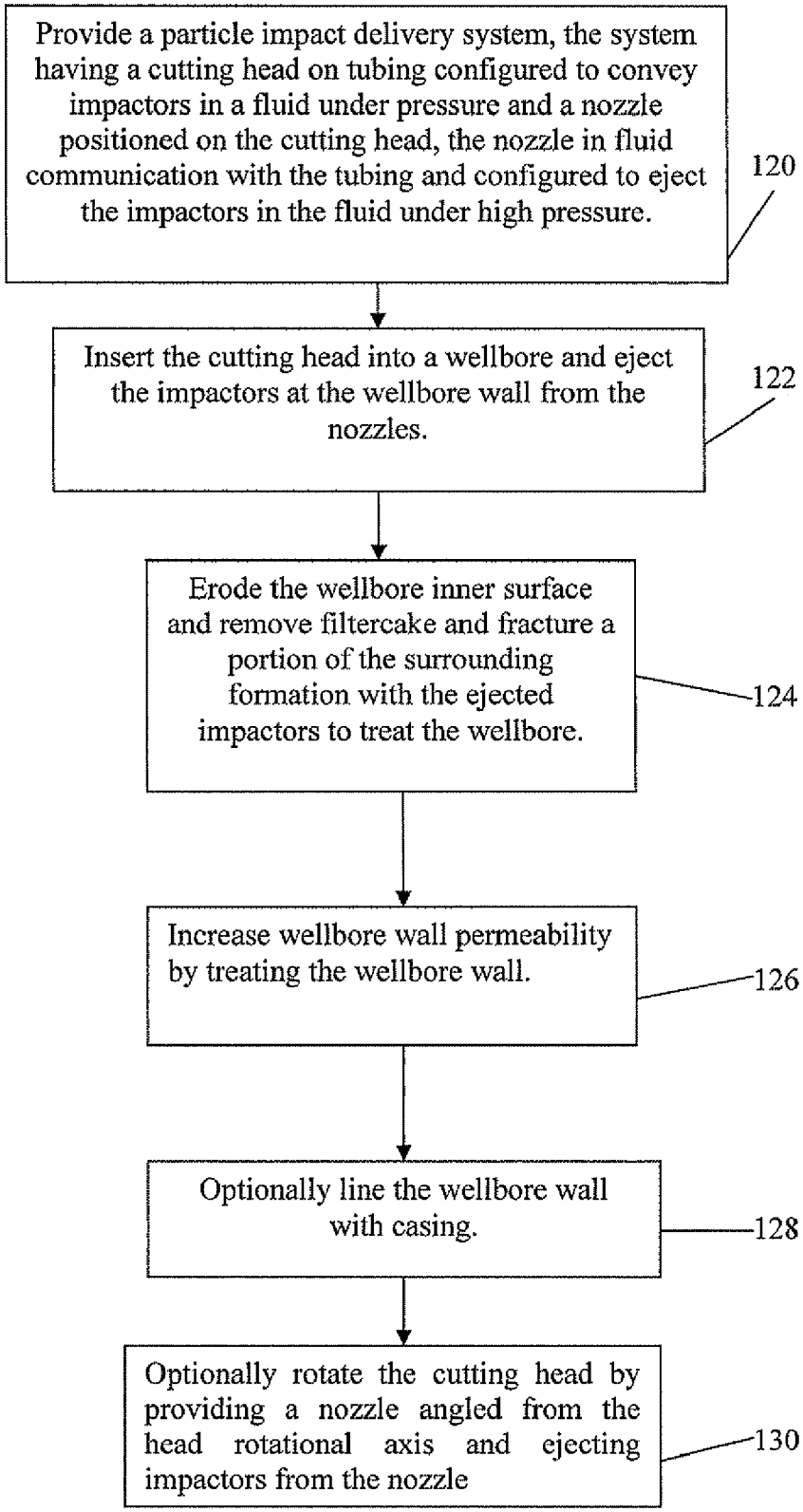
FIG. 31 illustrates a flow chart representing an embodiment of a method of use.

A particle impact drilling system, such as described herein, may be employed for removing filter cake. The system can include a cutting head 2087 attached to tubing 2087 configured to convey a mixture of impactors and pressurized circulating fluid to the cutting head 2087. A nozzle 2089 may be included that is in fluid communication with the tubing 2087*p* in one embodiment the nozzle 2089 is on the cutting head 2087. The nozzle 2089 being in fluid communication with the tubing and configured to eject the impactors in the fluid under high pressure. A method of using the particle impact system is demonstrated in the flow chart of FIG. 31. The method includes providing a PID system (step 120) inserting the cutting head 2087 of the particle impact drilling system 2083 into a borehole 2081 and ejecting impactors from the nozzle 2089 against the wall 2082 of the wellbore 2081 (step 122) thereby eroding filter cake and fracturing a portion of the surrounding formation with the ejected impactors. Fracturing the surrounding formation removes material and enlarges the borehole, which treats near bore producing formation damage by its removal (step 124). This method also increases the wellbore wall permeability (step 126).

Figure 25:
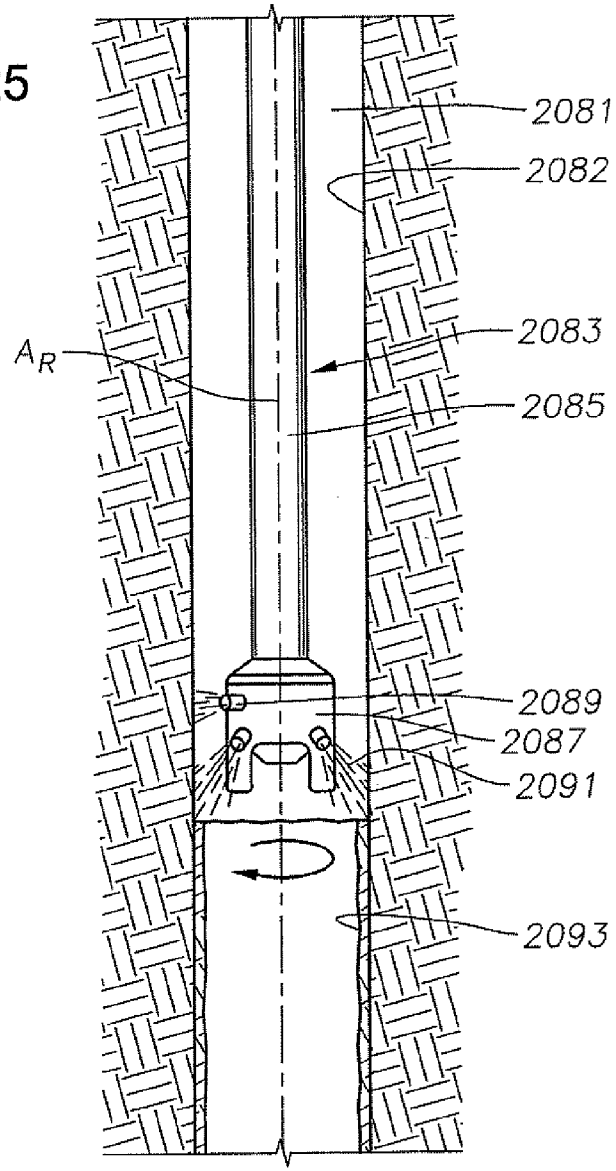
FIG. 25 portrays a side view of a particle drilling system used in modifying a wellbore wall according to an embodiment of the present invention.

PID technology can be utilized to remove wellbore mudcake by attaching a nozzle carrier to a drill string or tubular, then advancing and rotating the device in a borehole such that the damaged zone is removed at high rates of speed thereby leaving a production enhanced borehole surface. FIG. 25 illustrates a method of using a PID system 2083 within a wellbore 2081 for removing mudcake/filter cake 2093 from the wellbore wall 2082. In this embodiment, the system 2083 includes a cutting head 2087 disposed on the terminal end of a tubing string 2085. The cutting head 2087 includes nozzles 2089 formed to direct a spray pattern 2091 at the wellbore wall 2082 for removing the filter cake 2093 formed on the outer surface of the wall 2082. The system 2083 may optionally include a single nozzle, nozzle(s) may be disposed on the tubing string 2085, or the tubing string 2085 may include the sole nozzle carrier. Nozzle rotation within the borehole 2081 may occur by rotating the system 2083 from the surface, or by disposing a nozzle on the system 2083 at an angle to the system axis thereby using fluid discharge dynamics for system rotational energy (step 130). Nozzles may be configured to produce rotation of the cutting head 2087 about the cutting head rotational axis $A_R$. In one example, the nozzle extends outwardly from the cutting head outer surface at a radial angle from the cutting head rotational axis $A_R$, the angle may be preselected such as for example to maximize rotational force imparted onto the cutting head by the fluid exiting the nozzle. The fluid spray 2091 may be substantially as above described and thus include impactors. In one example of use of the system described herein, the radial thickness of the material removed from the wellbore inner circumference can exceed 0.5 inches. Since filtercake thickness typically ranges around 0.1 inches, the zone of erosion extends past the inner filtercake layer and into the near borehole, which provides for repair of near borehole damage. Repair of near borehole damage requires the impactors collide with the borehole wall with sufficient force to produce surface fractures in the formation surrounding the borehole. The present system therefore can remove filtercake and repair near borehole damage at the same time while improving permeability at the wellbore wall. The force of impact by the impactors on the wellbore wall depends on many factors, such as nozzle exit speed, annulus fluid properties, and the angle at which the impactor strikes the wall. In one embodiment, the nozzles may be gimbaled or angled with respect to the cutting head axis and the wellbore wall to thereby produce the desired impact force. The wellbore may be lined with casing after treatment (step 128).

Assisted Annular Flow

As discussed above, particle impact drilling systems, like typical drilling systems, recirculate drilling fluid in the annulus formed between the drill string and the wellbore inner diameter. Due to variations in annulus dimensions, drill pipe connections, rig and surface repairs or calibrations and running pills and slug flows, the recirculating flow may experience low flow zones. The low flow zones can allow high density particles in the fluid begin to move downhole due to gravity. Depending on the time the flow is off and the hole geometry, some areas in the annulus can accumulate high percentages of particles as the falling particles tend to mass in sections of the annulus. While flowing, sections of the annulus tend to accumulate a larger volume of particles. This usually occurs in areas where the annular velocity is reduced such as washed out areas of the borehole and an increase in casing inner diameter.

In these areas of accumulation of particles, it can be desirous to increase the local velocity by adding flow through the drill string (added subs most likely) at higher velocities than the annular velocity. The additional areas of higher velocity, tends to break up the accumulation of particles and get them flowing back to the surface. The break up of these areas of accumulation is valuable because the mass of particles tends to create areas where pressure energy is absorbed as the fluid travels through the circuitous paths in the particle mass. The preservation of pressure energy is one of the keys to successful drilling. These locations for increasing the local annular velocity can be placed anywhere in the drill string or surface equipment including the BOP stack as understood by those skilled in the art. It will be understood that assisted flow means can be employed in conjunction with the bit or separately as well conditions dictate.

As discussed above, PID technology has demonstrated it can excavate through hard formations 3-5 times the rate of conventional drill bit systems. Laboratory tests indicate a PID system can penetrate metals and metal composites at higher rates as well. As described above and in the referenced patents and patent applications, the PID system includes an injections means that deposits a small volume percent of the total downhole fluid flow with particles (impactors). The impactors are transported to the bit or cutting head where the impactors are accelerated through nozzles to velocities sufficient to deliver the energy required to fail and erode an impacted surface. The conventional fluid flow rate for oil and gas excavating operations imparts several million impacts per minute onto the excavation surface. After impact the impactors migrate to the surface for recovery and reinjection into the pressurized circulating fluid stream downhole.

Figure 32:
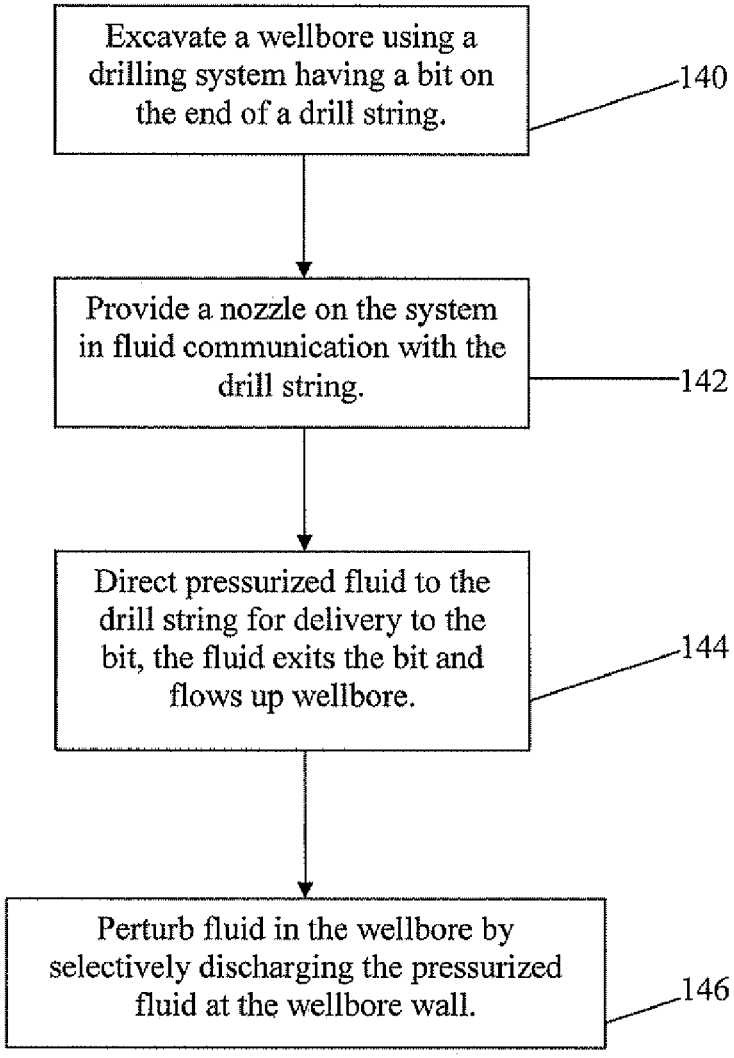
FIG. 32 illustrates a flow chart representing an embodiment of a method of use.

PID technology can be used for enhancing the flow of a drilling fluid in the annulus between a wellbore and a drill string, one embodiment of this method is illustrated in the flow chart of FIG. 32. A wellbore 2103 is excavated with a drilling system 2101 (step 140). The drilling system may include a bit 2115 disposed on the end of a drill string 2113. Pressurized drilling fluid is introduced into the drill string 2113 for delivery to the drill bit 2115. The pressurized drilling fluid exits the bit 2115 and flows up the wellbore 2103. A nozzle 2109 is included with the drilling system 2101 and is in fluid communication with the pressurized drilling fluid (step 142). Pressurized fluid is introduced into the drill string 2113 that flows to and out of the bit 2115 and back up the wellbore 2103 (step 144). The method includes selectively discharging pressurized drilling fluid from the nozzle 2109 into the annulus 2106 at localized low pressure regions to perturb the regions and promote annular flow of drilling fluid along the wellbore 2103 (step 146). The nozzle 2109 may be on the drill string 2113.

Figure 26:
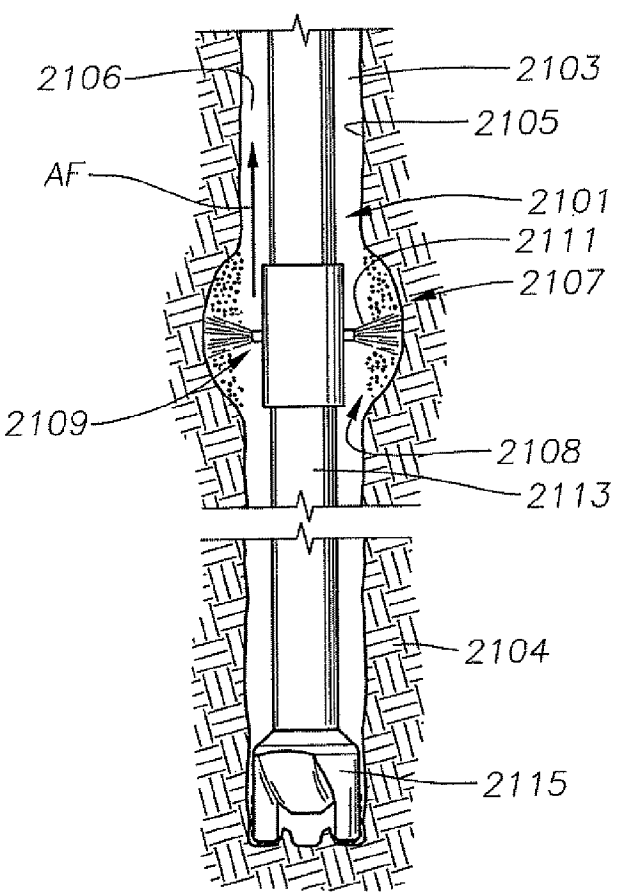
FIG. 26 is a side view of a system for promoting wellbore fluid flow according to an embodiment of the present invention.

FIG. 26 illustrates a specific embodiment of a drilling system 2101 having nozzles 2109 positioned for perturbing low flow zones in the drill string/wellbore annulus. The drilling system 2101 may include a standard wellbore drilling system as well as one employing particle impact drilling technology. The system 2101 includes a string 2113 having a drill bit 2115 affixed to its lower end. The embodiment of the system 2101 is used to form a wellbore 2103 through a formation 2104. A discontinuity 2107 on the wall 2105 of the wellbore 2103 allows fluid 2108 and debris (including impact particles) to accumulate and form a low flow region in the annulus 2106. Nozzle(s) 2109 are provided on the string 2113 and configured to direct a fluid spray 2111 away from the string 2113 towards the wellbore wall 2105. The fluid spray 2111 has sufficient momentum so that its impact on the low flow zone sufficiently perturbs the fluid 2108 and enables it to reemerge into the fluid flow $A_f$ flowing through the annulus 2106 towards the surface.

Coring Using a Particle Impact System

The most common method of obtaining reservoir and other downhole formations for analysis is coring. Coring usually consists of a core bit and a core barrel. The core bit can be of many different types depending on the target formation to be cored. The core bit, in general, has the outer portion of the bit having a cutting structure and the center of the bit being open. This configuration is reminiscent of a doughnut. The outer annular area has cutters attached to it and cuts a kerf in the formation while leaving the center portion of the rock intact. This center portion of rock is the core, or "undisturbed" part of the infinite reservoir or formation that has been left uncut and standing proud of the bottom hole. Depending of the strength of the rock being cut, different types and styles of core bits are used. In softer and medium strength rocks, core bits containing a cutting structure of polycrystalline diamond has advantages because of its faster rate of penetration and the ability of obtaining uninvaded core. As the rock becomes harder, core bits having a cutting structure of natural diamonds are often used. These bits cut slow but are able to cut harder rock while having a long cutting life. Hard and ultra hard rocks are usually cored with bits containing synthetic diamond crystals imbedded in a metallic composite matrix, more commonly known as an impregnated diamond core bit. The depth of cut is very, small, so the rate at which the core is cut also very slow. One method that is used to increase the rate of penetration is to increase the rotary speed by tying the core bit and barrel to a hydraulic downhole motor or turbine. Although this can increase the performance, the rate at which these harder rocks are cored is still quite slow.

The conventional core bits as described above use mechanical energy to cut the formation surrounding the core. This is done by rotating the drill string from the surface and applying a force to the bit adding weight to it. The cutting and performance is dependant of the torque produced. Although torque is needed to cut the formation around the core, it can also be detrimental in obtaining an undamaged core or cutting the desired length of core (rock) to be brought to the surface for analysis. As the core is being produced by continually cutting the formation external to the core, the core becomes essentially a cylinder of rock that the core barrel and its inner barrel is slipped over the core as the core bit advances into the target formation. These columns of cut core typically are in the neighborhood of 30 to 60 feet long but have recovered being almost 600 feet in length. The ability to obtain the desired length of core for a single run can be can be altered drastically by the torque developed at the core bit. With moderate to high levels of torque, the core entering the core barrel can easily be caught when torque fluctuations cause the bit or barrel to bind against the core and easily break the core. Rotary speed can also cause the core to break as the drilling fluid between the outer barrel and the inner barrel of the core barrel creates enough shear forces on the inner barrel to make it rotate and apply torque directly to the core.

Normally cores are not recovered intact but will be broken periodically. It is when the core does not break approximately perpendicular to the longitudinal axis of the core where many problems arise. If the break is at an angle to the axis of the core, and the core can slip along this fracture plane, it can become a radially loaded plug and prohibit the core from advancing into the barrel. If the core cannot advance into the barrel, the bit cannot continue to care at a reasonable rate and in many cases the penetration is stopped. The loads that are applied via the angled fracture are larger if there is an appreciable amount of core in the barrel as the weight of the core forces the core to slip along the fracture plane and develop very high lateral loads which jam the core in the barrel.

The value of a core is based on size of the core taken, the amount of damage the core has experienced, and accurate depth history. The cost of coring is an issue that is always analyzed in terms of cost benefit. The speed at which a core can be taken is a major part of the cost to benefit equation. Deep, hard, or lensed formations can take a significant amount of rig time, therefore cost, to obtain. Side wall coring has been used in some cases to defer the cost of full hole coring. A series of strong tubes attached to a downhole tool can be shot into the side of a borehole, where the formation is trapped in the tubes and recovered. Some small diameter core heads and drills have been used to cut small and short cores from the hole wall. The drawback to sidewall coring is the small diameter and volume of the core produced and the damage that is done while shooting into the formation. The types of rock fabric and mineralogy can be gleaned from these samples but critical reservoir information is most likely not obtainable from the small samples.

As discussed above, PID technology has demonstrated it can excavate through hard formations 3-5 times the rate of conventional drill bit systems. Laboratory tests indicate a PID system can penetrate metals and metal composites at higher rates as well. As described above and in the referenced patents and patent applications, the PID system includes an injections means that deposits a small volume percent of the total downhole fluid flow with particles (impactors). The impactors are transported to the bit or cutting head where the impactors are accelerated through nozzles to velocities sufficient to deliver the energy required to fail and erode an impacted surface. The conventional fluid flow rate for oil and gas excavating operations imparts several million impacts per minute onto the excavation surface. After impact the impactors migrate to the surface for recovery and reinjection into the pressurized circulating fluid stream downhole.

A device employing PID technology can be used for retrieving subterranean core samples. The device may include an elongated body 2129 and a core bit 2131 affixed to the lower end of the body 2129. A cutting surface may be included with the bit 2131 having a nozzle 2133 formed on the core bit cutting surface. The nozzle 2133 as shown is configured for discharging impactors in a pressurized fluid at high velocity for cutting through formation 2128 to obtain core samples. The body 2129 may be configured to receive core samples therein.

Figure 27:
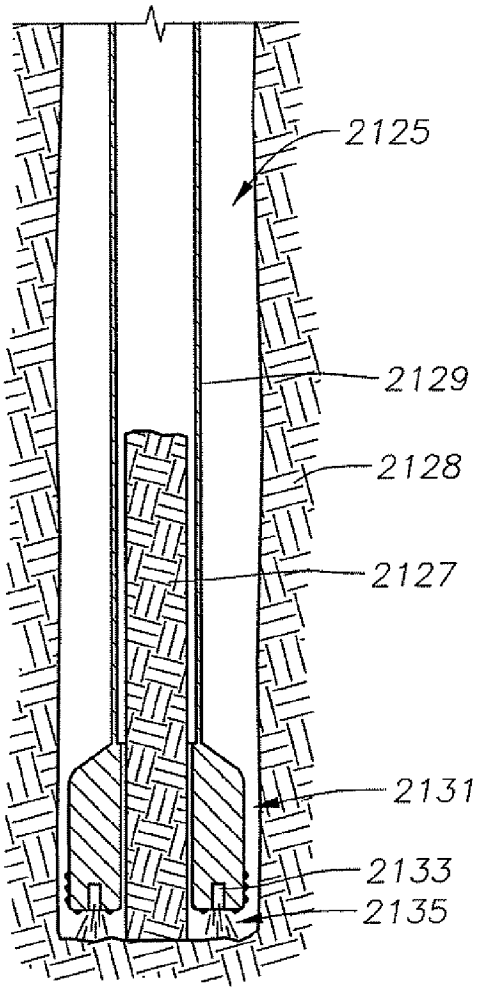
FIG. 27 is a side view of an embodiment of a coring bit using particle drilling according to an embodiment of the present invention.
Figure 33:
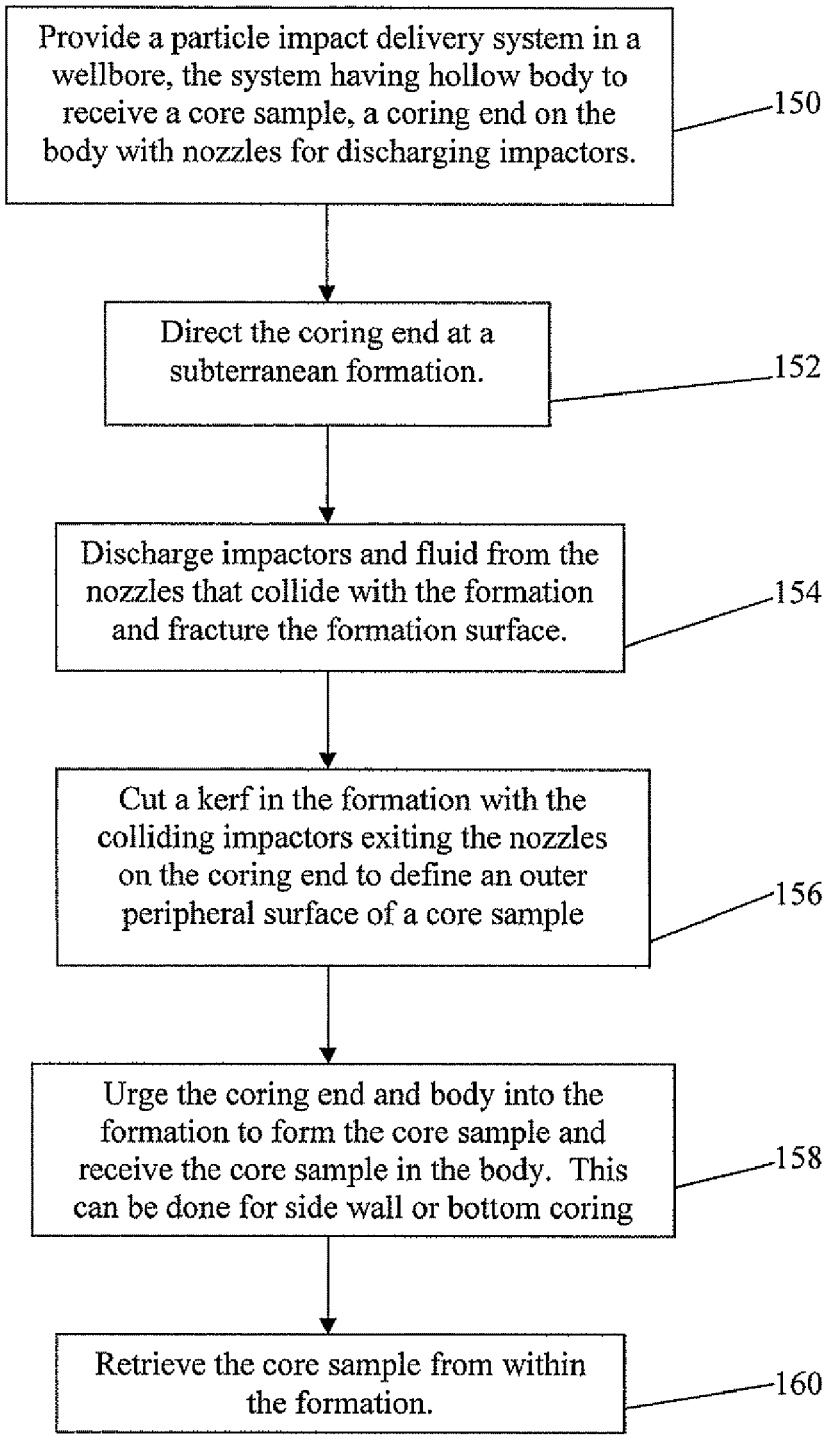
FIG. 33 illustrates a flow chart representing an embodiment of a method of use.

An example of a coring system 2125 employing particle impact technology is illustrated in FIG. 27. The coring system 2125 includes a generally cylindrically shaped body 2129 configured to transfer rotational force to a particle impact cutting head 2131. The body 2129 is also shaped to receive a core sample 2127 within its annular opening. The cutting head 2131 as shown includes nozzles 2133 that receive and discharge a mixture of impactors and pressurized circulating fluid. The mixture discharges from the nozzles 2133 to create a stream 2135 having impactors, the stream 2135 is directed at the formation 2128 from which a core sample 2127 is to be retrieved. A method of use is illustrated in FIG. 33, where the method includes providing the coring system 2125 (step 150). The coring end (cutting head 2131) is directed at the subterranean formation 2128 (step 152) and impactors and fluid are discharged from the nozzles 2133 that impact and fracture the formation 2128 (step 154). This creates a kerf in the formation 2128 that defines the sample core outer periphery (step 156). The coring end is further urged into the formation which further forms the core sample 2127 that is received in the body 2129 (step 158). The core end can be fractured and retrieved from the wellbore (160). This procedure can be done for bottom hole or side wall coring.

Cutting head 2131 embodiments exist having multiple nozzles 2133 arranged on the body 2129 opening that form a stream 2135 that circumscribes the core sample 2127. Optionally, the cutting head 2131 rotates to orbit the nozzles 2133 around the body 2129 axis to thereby form the kerf. Rotating the cutting 2131 can require fewer nozzles 2133, possibly as few as a single nozzle 2133. Implementing particle impact technology for core sampling can increase sample core diameter, which is due in part because the particle impingement produces thinner kerfs. Larger cores are less likely to be damaged by applied torque but are subjected to minimal torque since the cutting structure is not dependent of torque to excavate rock formations. In addition the performance of PID can be produced with very low rotary speed, which also reduces applied torque to the core.

The high rates of penetration exhibited by PID positively affect the reduction of damage to a core by invasion or fluid displacement as these are dependent on the time a core is exposed to the drilling fluid and the degree of damage to the filter cake that dynamically and statically form on the exterior or the core. Larger diameters will also provide more undamaged core as the depth of the invasion damage takes place on the exterior of the core and is uniform in depth if left undisturbed leaving a larger diameter of undamaged core. By having the ability to cut larger diameter cores and thinner kerfs makes PID coring a vastly improved technique for coring, including sidewall coring as understood by those skilled in the art. Larger diameter cores can be taken potentially without secondary power sources by allowing the PID nozzle heads to rotate using the forces created by angling the jets enough to establish rotation. PID technology performance is almost independent of rotary speed so applied torque is minimal.

It is recognized that although conventional core barrels might function with the PID technology, fit for purpose core barrels containing dedicated flow channels that feed the nozzle(s) with high pressure fluid laden with particles might be needed to extract the full performance of the PID coring system.

Perforating

After a wellbore has been drilled and cased with steel pipe cemented in the hole, the borehole is without communication to the producing formations that it was most likely drilled to produce. The most common methods of establishing communication from the producing formations and the borehole are through "perforating". Perforating can use means to open holes through the casing and attaching cement into the producing formations. The continuous hole through the casing and into the producing formation allows crude petroleum and natural gas to migrate to the lower pressure borehole where it flows or is pumped to the surface for collection.

Early methods of perforating included the use of lowering "guns", strings of radial oriented bullets in small diameter steel housing, to the depth of the production interval of interest and firing the gun. Bullets, after being fired, travel through the easing and into the formation creating a channel behind them. This channel is commonly referred to as a carrot because of the shape of the channel which tapers inward from its entry into the formation to the diameter of the bullet. The bullet expends enough energy traveling through the casing or multiple casings and cement into the formation to create a relatively short wound channel or carrot. The rock at depth is stressed due to the overburden and horizontal stresses which increase with depth at about one pound per square inch per foot of depth. Not only are the producing formations by themselves strong, but at depth have significant additional strengthening from the stress of being buried.

Wild claims of the lengths of these carrots were published and advertised until surface tests with simulated stress conditions were performed. These tests showed carrots only a fraction of the lengths as previously thought. The carrots have a surface area based on the geometry and length. The much reduced surface area from the short carrots limited production as well as producing mostly from "near wellbore" portions of the production formation unless the carrot intersected a fracture that extended further into the formation. In addition to the carrots being much shorter than expected the bullets created very fine formation fragments as it was shot into the rock. These fragments were usually jammed into the walls of the carrot as it was being formed reducing its ability to produce. The carrots were flushed in many cases with acid in an attempt to remove the fragments nesting in the pore spaces of the rock and increase the formation permeability and therefore the production.

Although bullets may still be used to perforate the casing, newer technology was developed that overcame many of the shortcomings of bullet perforating. The development by the military to pierce armor found on tanks and the like, with a shaped charge, proved to be instrumental in the introduction of perforating using shaped charges. This is the most common and preferred method of perforating today Perforating guns are loaded with many shaped charges aimed radially. The gun is tripped into the hole until the appropriated depth is reached. The gun(s) are set off electronically. The explosion of the charge is designed to strike the casing with a high velocity and high temperature wave front which removes the casing, cement and formation. The results of the shape charge produced carrot are significantly longer that the bullet formed carrots. Depending on the increasing strength of the stressed formation, the performance of the shape charge perforation can be severely reduced.

As discussed above, PID technology has demonstrated it can excavate through hard formations 3-5 times faster than conventional drill bit systems. Laboratory tests indicate a PID system can penetrate metals and metal composites at higher rates as well. As described above and in the referenced patents and patent applications, the PID system includes an injection means that deposits a small volume percent of the total downhole fluid flow with particles (impactors). The impactors are transported to the bit or cutting head where the impactors are accelerated through nozzles to velocities sufficient to deliver the energy required to fail and erode an impacted surface. The conventional fluid flow rate for oil and gas excavating operations imparts several million impacts per minute onto the excavation surface. After impact the impactors migrate to the surface for recovery and reinjection into the pressurized circulating fluid stream downhole.

Figure 28:
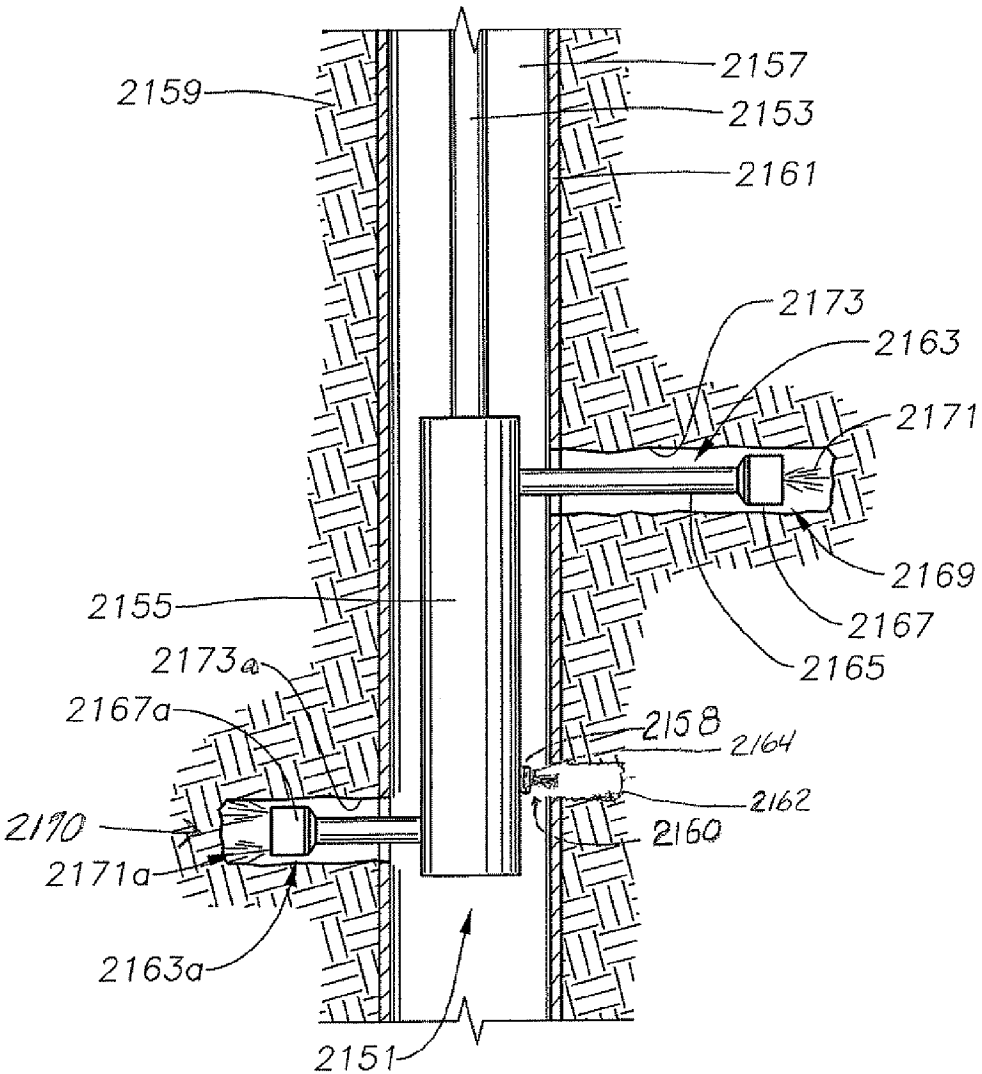
FIG. 28 is a side view of a wellbore perforating device according to an embodiment of the present invention.
Figure 34:
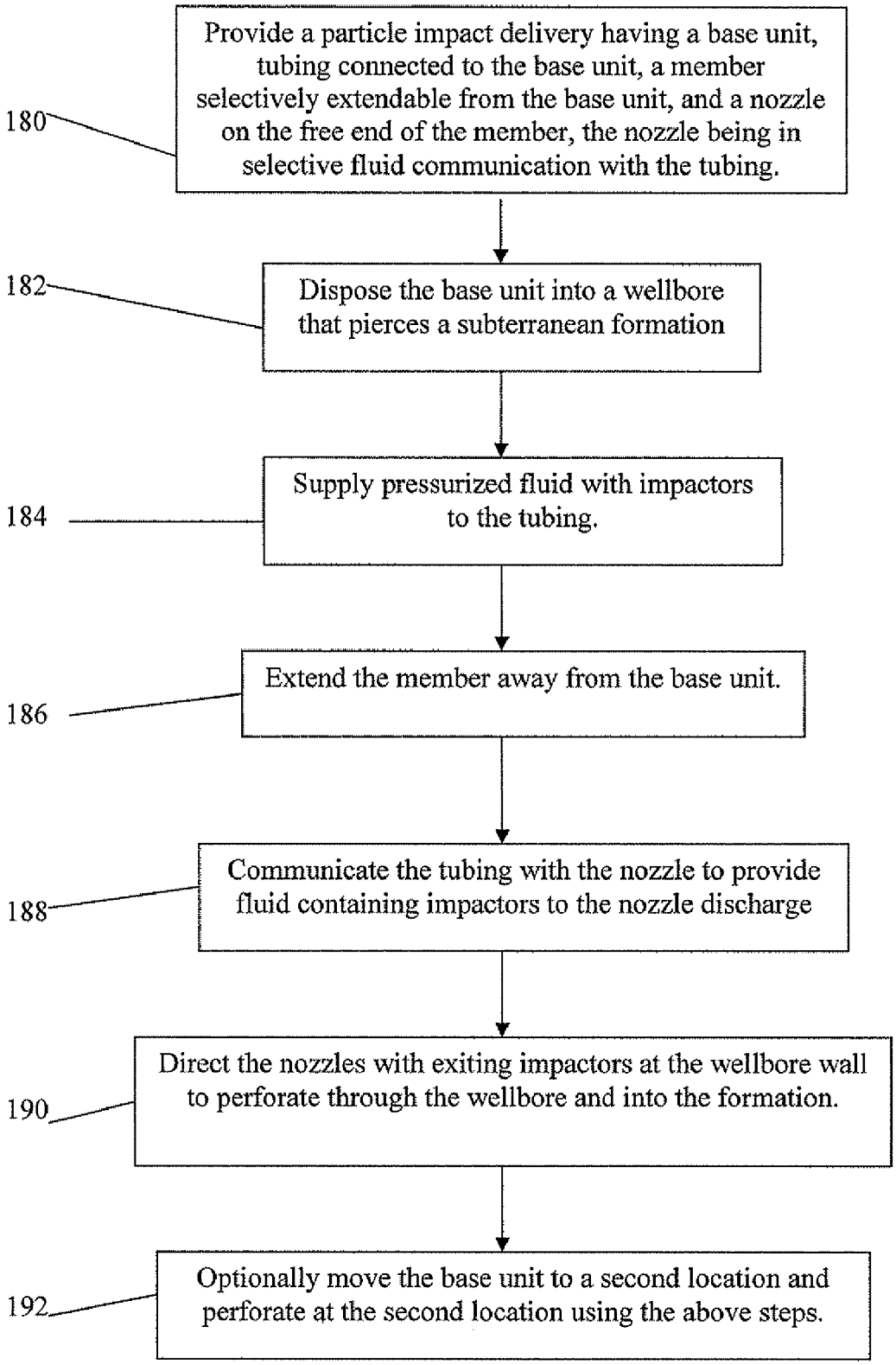
FIG. 34 illustrates a flow chart representing an embodiment of a method of use.

PID technology can be used for perforating a wellbore with a perforating system 2151. It should be noted that by perforating with the PID system the type of damage to the carrot surfaces by conventional means is virtually eliminated. As illustrated in FIG. 28, one embodiment of a perforating system 2151 includes a base unit 2155, tubing 2153 connected to the base unit 2155, a member 2158 on the base unit 2155 having a nozzle 2164 formed therein, a member 2163 on the base unit 2155 selectively extendable from the base unit 2155, and a nozzle 2169 on the free end of the member 2163. Embodiments of the perforating system 2151 also include a base unit 2155 with only nozzles affixed thereon, only selectively extendable members, or combinations thereof. The tubing 2153 selectively communicates pressurized fluid having impactors to the base unit 2155 for delivery to one or more of the nozzles (2164, 2169, 2170). In an example of use of this method, as shown in the flow chart of FIG. 34, a system 2151 as described above is provided for use (step 180). The base unit 2155 is disposed into a wellbore 2157 (step 182) and pressurized fluid having impactors is supplied to the tubing 2153 (step 184). The nozzle 2164 is directed at the wellbore wall (step 190). The tubing 2153 is put into fluid communication with the member 2158 and thus the nozzle 2164, where fluid containing impactors exits the nozzle 2164 forming a spray pattern 2160 directed at the casing 2161. The spray pattern 2160 containing the impactors erodes the casing 2161 and surrounding formation 2159 to create a perforation 2162. Perforating members 2163 and 2163*a* are selectively extendable (step 186) from a stowed position where their respective nozzles (2169, 2170) are adjacent the base unit 2155 to an extended or deployed position away from the base unit 2155 as shown in FIG. 28. The command to extend may be from the wellbore surface. Fluid can be communicated to the members (2163, 2163*a*) while in the stowed position, the deployed position, or while extending. Communicating fluid to the perforating member 2163 in turn communicates the fluid with the nozzle 2169 (step 188) thereby providing fluid containing impactors to the nozzle discharge. The nozzles 2169 with exiting impactors are directed at the casing 2161 (step 190) and erode through the casing 2161 and formation 2159 to form perforations 2173 through the wellbore 2157.

In one specific example of perforating using perforating impact technology, a nozzle having exiting impactors is used to excavate formation adjacent a wellbore. The nozzle may be placed at the tip of a limber supply tube and positioned such that as the impactors are accelerated through the nozzle to impact the wellbore casing and form a path into the surrounding formation. An embodiment of a PID perforating system 2151 is shown schematically in FIG. 28. The system 2151 includes a body 2155 suspended in a wellbore 2157 by tubing 2153. The tubing 2153 thus can support the body 2155 and provide a conduit for pressurized fluid and associated impactors. After forming a perforation in one location, the system may be relocated in the wellbore 2157 at another depth for one or more perforations (step 192).

A perforating member 2163 is shown laterally extending from the body 2155 and forming a perforation 2173 through casing 2161 that lines the wellbore 2157 and into the surrounding formation 2159. The member 2163 includes an extendable shaft 2165 having excavating means on its end for forming the perforation 2173. The excavation means includes a shaft end 2167 having a nozzle 2169 for directing an excavating impact fluid spray (or stream) 2171 at the formation 2159, where the fluid spray 2171 comprises a mixture of impactors in a pressurized circulating fluid. Because the shaft 2165 is extendable, the dimensions of the resulting perforation 2173 are only limited by the dimensions of the shaft 2165. The system 2151 may include multiple excavating members. An optional embodiment of an extendable member 2163*a* employs an end 2167*a* having dual nozzles 2170 for creating multiple spray flows 2171*a* for excavating a perforation 2173*a*.

The member 2163 can be advanced into the formation via mechanical means or hydraulics. A nozzle and supply tube can have force applied to it much like blowing into a closed drinking straw and advance due to those forces. Multiple nozzles and supply tubes can be utilized at the same in order to form many perforations at the same time.

It is also possible to form perforations from a fixed platform dropped into the cased borehole. Once the platform (gun) is in place fluid and impactors are flowed through each nozzle, creating an opening into the casing, cement and formation. The length and diameter of the perforation is dependant on the decay rate of the impactors and the strength of the rock. Although the time it takes is not as fast as a shaped charge, PID perforating can be done at high rates of penetration while leaving a much larger (higher surface area) carrot to improve production in both the short and long term. Those advantages far outweigh the difference in time to create a drastically improved perforation as time is not the driver to better perforating but the quality of the formed perforation.

This application claims priority to and the benefit of co-pending U.S. Provisional Application Ser. No. 61/025,589, filed Feb. 1, 2008, the full disclosure of which is hereby incorporated by reference herein. This application is related to U.S. provisional patent application Ser. No. 60/463,903, filed on Apr. 16, 2003; U.S. Pat. No. 6,386,300, issued on May 14, 2002, which was filed as application Ser. No. 09/665,586 on Sep. 19, 2000; U.S. Pat. No. 6,581,700, issued on Jun. 24, 2003, which was filed as application Ser. No. 10/097,038 on Mar. 12, 2002; pending application Ser. No. 10/897,196, filed on Jul. 22, 2004; pending application Ser. No. 11/204,981, filed on Aug. 16, 2005; pending application Ser. No. 11/204,436, filed on Aug. 16, 2005; pending application Ser. No. 11/204,862, filed on Aug. 16, 2005; pending application Ser. No. 11/205,006, filed on Aug. 16, 2005; pending application Ser. No. 11/204,772, filed on Aug. 15, 2005; pending application Ser. No. 11/204,442, filed on Aug. 16, 2005; pending application Ser. No. 10/825,338, filed on Apr. 15, 2004; pending application Ser. No. 10/558,181, filed on May 14, 2004; pending application Ser. No. 11/344,805, filed on Feb. 1, 2006; pending application Ser. No. 11/801,268, filed May 9, 2007; pending application Ser. No. 60/899,135, filed Feb. 2, 2007, pending application Ser. No. 11/773,355, filed Jul. 3, 2007 pending application No. 60/959,207, filed Jul. 12, 2007, and pending application No. 60/978,653, filed Oct. 9, 2007, the disclosures of which are incorporated herein by reference.

In the drawings and detailed description, there have been disclosed typical embodiments of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the attached claims.

That claimed is:

1. A method of milling an object in a wellbore comprising:

(a) providing in the wellbore a drill string and a drill bit with nozzles thereon that are in fluid communication with the drill string;

(b) flowing a mixture of impactors and pressurized circulating fluid within the drill string so that the impactors in the mixture exit the nozzles with sufficient energy to structurally alter the object when contacting the object; and (c) eroding the object by directing at least one of the nozzles at the object while impactors exit the at least one nozzle so that the exiting impactors contact and structurally alter the object.

2. A method as defined in claim 1, wherein the object is selected from the list consisting of casing lining the wellbore, objects stuck in the wellbore, and a drill bit attached to casing used to drill the wellbore.

3. A method as defined in claim 1, further comprising rotating the bit by ejecting pressurized fluid from a nozzle on the bit in a direction lateral to and offset from the bit axis.

4. A method as defined in claim 1, further comprising disposing a whipstock in the wellbore for directing the nozzle orientation.

5. A method as defined in claim 1, further comprising continuing the step of eroding the object until the object is removed from the wellbore thereby milling the object.

6. A method as defined in claim 1, further comprising replacing the drill bit with a cutting member selected from the list consisting of a bit, a mill, a lead mill, a modified bit, and a modified mill.

* * * * *